US008309509B2

(12) United States Patent
Bartelme et al.

(10) Patent No.: US 8,309,509 B2
(45) **Date of Patent: *Nov. 13, 2012**

(54) FAST DISSOLVING SOLID DETERGENT

(75) Inventors: Michael Bartelme, Eden Prairie, MN (US); Julie Marquardt, Savage, MN (US); Steve E. Lentsch, St. Paul, MN (US); Victor F. Man, St. Paul, MN (US); Brian Robert Leafblad, St. Paul, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/315,014

(22) Filed: Dec. 8, 2011

(65) Prior Publication Data

US 2012/0142576 A1 Jun. 7, 2012

Related U.S. Application Data

(63) Continuation of application No. 11/675,415, filed on Feb. 15, 2007, now Pat. No. 8,093,200.

(51) Int. Cl.
*C11D 17/00* (2006.01)
*C11D 3/10* (2006.01)
*C11D 3/20* (2006.01)

(52) U.S. Cl. ..... 510/445; 510/446; 510/108; 510/224; 510/294; 510/298; 510/451; 510/509; 510/514; 510/521

(58) Field of Classification Search ..... 510/445, 510/446, 108, 224, 294, 298, 451, 509, 514, 510/521
See application file for complete search history.

(56) References Cited

U.S. PATENT DOCUMENTS

| | | | |
|---|---|---|---|
| 3,048,548 | A | 8/1962 | Martin et al. |
| 3,334,147 | A | 8/1967 | Brunelle et al. |
| 3,553,139 | A | 1/1971 | Mccarty et al. |
| 4,101,457 | A | 7/1978 | Place et al. |
| 4,261,868 | A | 4/1981 | Hora et al. |
| 4,426,362 | A | 1/1984 | Copeland et al. |
| 4,435,307 | A | 3/1984 | Barbesgaard et al. |
| 4,507,219 | A | 3/1985 | Hughes |
| 4,585,795 | A | 4/1986 | Linderborg |
| 4,595,520 | A | 6/1986 | Heile et al. |
| 4,652,392 | A | 3/1987 | Baginski et al. |
| 4,680,134 | A | 7/1987 | Heile et al. |
| 4,687,121 | A | 8/1987 | Copeland |
| 4,690,305 | A | 9/1987 | Copeland |
| RE32,763 | E | 10/1988 | Fernholz et al. |
| RE32,818 | E | 1/1989 | Fernholz et al. |
| 4,826,661 | A | 5/1989 | Copeland |
| 4,830,773 | A | 5/1989 | Olson |
| 4,883,612 | A | 11/1989 | Moyne et al. |
| 4,992,107 | A | 2/1991 | Itoku et al. |
| 5,053,158 | A | 10/1991 | Dixit et al. |
| 5,075,027 | A | 12/1991 | Dixit et al. |
| 5,078,301 | A | 1/1992 | Gladfelter et al. |
| 5,118,440 | A | 6/1992 | Cutler et al. |
| 5,188,752 | A | 2/1993 | Prencipe et al. |
| 5,188,769 | A | 2/1993 | Connor et al. |
| 5,198,198 | A | 3/1993 | Gladfelter et al. |
| 5,209,863 | A | 5/1993 | Dixit et al. |
| 5,223,179 | A | 6/1993 | Connor et al. |
| 5,234,615 | A | 8/1993 | Gladfelter et al. |
| 5,286,402 | A | 2/1994 | Geke et al. |
| 5,316,688 | A | 5/1994 | Gladfelter et al. |
| 5,451,342 | A | 9/1995 | Desai |
| 5,453,216 | A | 9/1995 | Kellet |
| 5,489,395 | A | 2/1996 | Behler et al. |
| 5,545,354 | A | 8/1996 | Ofosu-asante |
| 5,599,400 | A | 2/1997 | Mao et al. |
| 5,663,131 | A | 9/1997 | Winicov et al. |
| 5,670,677 | A | 9/1997 | Ponsati Obiols et al. |
| 5,688,753 | A | 11/1997 | Cala et al. |
| 5,695,575 | A | 12/1997 | Angevaare et al. |
| 5,698,046 | A | 12/1997 | St. Laurent et al. |
| 5,705,465 | A | 1/1998 | Angevaare et al. |
| 5,736,503 | A | 4/1998 | Vinson |
| 5,747,439 | A | 5/1998 | Dunn et al. |
| 5,755,893 | A | 5/1998 | Cala et al. |
| 5,814,588 | A | 9/1998 | Cala et al. |
| 5,858,299 | A | 1/1999 | Fernholz et al. |
| 5,888,955 | A | 3/1999 | Foley et al. |
| 5,891,836 | A | 4/1999 | Kacher |
| 5,902,415 | A | 5/1999 | Dunn et al. |
| 5,919,744 | A | 7/1999 | Lazarowitz |
| 5,981,457 | A | 11/1999 | Ahmed |
| 6,080,331 | A | 6/2000 | Meszaros et al. |

(Continued)

FOREIGN PATENT DOCUMENTS

| | | |
|---|---|---|
| DE | 2247832 | 4/1975 |

(Continued)

OTHER PUBLICATIONS

Davidson and Sittig, "Water Soluble Resins", Van Nostrand Reinhold Company, New York (1968).

J. Biol. Chem., 260(11):6518-6521 (1985).

Kirk-Othmer, "Encyclopedia of Chemical Technology", Third Edition, vol. 8, pp. 900-912.

Scott, D., (Editors Grayson, M. and EcKroth, D.), "Industrial Enzymes", in Kirk-Othmer Encyclopedia of Chemical Technology, 3rd Edition, vol. 9, pp. 173-224, John Wiley & Sons, New York, 1980.

Tomarelli, R. M., Charney, J., and Harding, M. L., "The Use of Azoalbumin as a Substrate in the Colorimetric Determination of Peptic and Tryptic Activity", J. Lab. Clin. Chem. 34, 428 (1949).

(Continued)

*Primary Examiner* — Lorna M Douyon
(74) *Attorney, Agent, or Firm* — Merchant & Gould P.C.

(57) ABSTRACT

A solid block or unit dosed detergent composition as described which can be utilized in a variety of applications for cleaning surfaces and objects, removing suspending soils, and rinsing easily. The detergent composition, when exposed to an aqueous solution such as water, dissolves quickly and completely to create the use solution.

12 Claims, No Drawings

U.S. PATENT DOCUMENTS

| | | | | |
|---|---|---|---|---|
| 6,124,253 | A | 9/2000 | Vinci et al. | |
| 6,136,778 | A | 10/2000 | Kamiya | |
| 6,156,715 | A | 12/2000 | Lentsch et al. | |
| 6,162,777 | A | 12/2000 | Gorlin et al. | |
| 6,177,392 | B1 | 1/2001 | Lentsch et al. | |
| 6,187,733 | B1 | 2/2001 | Fabry et al. | |
| 6,228,825 | B1 | 5/2001 | Gorlin et al. | |
| 6,258,765 | B1 | 7/2001 | Wei et al. | |
| 6,274,539 | B1 | 8/2001 | Kacher et al. | |
| 6,281,181 | B1 | 8/2001 | Vinson et al. | |
| 6,303,553 | B1 | 10/2001 | Gorlin | |
| 6,309,559 | B1 | 10/2001 | Minks et al. | |
| 6,410,495 | B1 | 6/2002 | Lentsch et al. | |
| 6,475,977 | B1 | 11/2002 | Pfeiffer et al. | |
| 6,503,879 | B2 | 1/2003 | Lentsch et al. | |
| 6,539,954 | B1 | 4/2003 | Schimmel et al. | |
| 6,551,984 | B1 | 4/2003 | Arvanitidou et al. | |
| 6,583,094 | B1 | 6/2003 | Lentsch et al. | |
| 6,589,926 | B1 | 7/2003 | Vinson et al. | |
| 6,632,785 | B2 | 10/2003 | Pfeiffer et al. | |
| 6,653,266 | B2 | 11/2003 | Wei et al. | |
| 6,660,707 | B2 | 12/2003 | Lentsch et al. | |
| 6,730,653 | B1 | 5/2004 | Smith et al. | |
| 6,825,159 | B2 | 11/2004 | Man et al. | |
| 6,831,054 | B2 | 12/2004 | Lentsch et al. | |
| 6,936,577 | B2 | 8/2005 | Dontula et al. | |
| 7,037,886 | B2 | 5/2006 | Smith et al. | |
| 7,087,569 | B2 | 8/2006 | Lentsch et al. | |
| 7,094,746 | B2 | 8/2006 | Lentsch et al. | |
| 7,153,820 | B2 * | 12/2006 | Olson et al. | 510/451 |
| 7,387,991 | B2 | 6/2008 | Hudson | |
| 8,093,200 | B2 * | 1/2012 | Bartelme et al. | 510/445 |
| 2003/0078176 | A1 | 4/2003 | Elsner et al. | |
| 2003/0100464 | A1 | 5/2003 | Kott et al. | |
| 2004/0005991 | A1 | 1/2004 | Boucher et al. | |
| 2004/0063598 | A1 | 4/2004 | Riebe et al. | |
| 2004/0157760 | A1 * | 8/2004 | Man et al. | 510/302 |
| 2006/0079428 | A2 | 4/2006 | Wiedemann et al. | |
| 2008/0280806 | A1 | 11/2008 | Bartelme et al. | |

FOREIGN PATENT DOCUMENTS

| | | |
|---|---|---|
| EP | 0216301 | 4/1987 |
| EP | 303761 | 3/1988 |
| EP | 0510945 | 10/1992 |
| EP | 0519603 | 12/1992 |
| EP | 0541203 | 5/1993 |
| EP | 0541204 | 5/1993 |
| EP | 0560615 | 9/1993 |
| EP | 341947 | 8/1994 |
| EP | 0652931 | 5/1995 |
| EP | 0984055 | 3/2000 |
| EP | 0997521 | 5/2000 |
| EP | 0997522 | 5/2000 |
| EP | 130756 | 6/2000 |
| EP | 1127939 | 8/2001 |
| EP | 1213344 | 6/2002 |
| EP | 1232236 | 8/2002 |
| EP | 1254947 | 11/2002 |
| GB | 1243784 | 8/1971 |
| GB | 1296839 | 11/1972 |
| GB | 1372034 | 10/1974 |
| GB | 2095275 | 3/1981 |
| GB | 2075028 | 11/1981 |
| JP | 5320487 | 12/1993 |
| JP | 09188899 | 7/1997 |
| KR | 2005-0098528 | 10/2005 |
| WO | WO8908694 | 9/1989 |
| WO | WO9117243 | 11/1991 |
| WO | WO9203529 | 3/1992 |
| WO | WO9205249 | 4/1992 |
| WO | WO9307260 | 4/1993 |
| WO | WO9307263 | 4/1993 |
| WO | WO 93/14183 | 7/1993 |
| WO | WO9318140 | 9/1993 |
| WO | WO9402597 | 2/1994 |
| WO | WO 94/09100 | 4/1994 |
| WO | WO9414951 | 7/1994 |
| WO | WO9418314 | 8/1994 |
| WO | WO9425583 | 11/1994 |
| WO | WO 95/05441 | 2/1995 |
| WO | WO 95/06106 | 3/1995 |
| WO | WO 95/06107 | 3/1995 |
| WO | WO 95/06108 | 3/1995 |
| WO | WO 95/07334 | 3/1995 |
| WO | WO9507791 | 3/1995 |
| WO | WO9509909 | 4/1995 |
| WO | WO9510591 | 4/1995 |
| WO | WO9510603 | 4/1995 |
| WO | WO9510615 | 4/1995 |
| WO | WO 95/19422 | 7/1995 |
| WO | WO 95/20027 | 7/1995 |
| WO | WO9526397 | 10/1995 |
| WO | WO 95/29223 | 11/1995 |
| WO | WO9529979 | 11/1995 |
| WO | WO9530010 | 11/1995 |
| WO | WO9530011 | 11/1995 |
| WO | WO9623873 | 8/1996 |
| WO | WO 96/41859 | 12/1996 |
| WO | WO 97/00930 | 1/1997 |
| WO | WO 97/25397 | 7/1997 |
| WO | WO 97/29172 | 8/1997 |
| WO | WO 97/44423 | 11/1997 |
| WO | WO 98/51767 | 11/1998 |
| WO | WO 99/11746 | 3/1999 |
| WO | WO 99/19439 | 4/1999 |
| WO | WO 00/43474 | 7/2000 |
| WO | WO 00/43475 | 7/2000 |
| WO | WO 00/43476 | 7/2000 |
| WO | WO 00/43477 | 7/2000 |
| WO | WO 00/43479 | 7/2000 |
| WO | WO 03/006571 | 1/2003 |
| WO | WO 2006/096477 | 9/2006 |

OTHER PUBLICATIONS

Zahradnik, M., "The Production and Application of Fluorescent Brightening Agents", Published by John Wiley & Sons, New York (1982).

U.S. Statutory Invention Registration No. H1513, Murch et al. Jan. 2, 1996.

* cited by examiner

FAST DISSOLVING SOLID DETERGENT

CROSS REFERENCE TO RELATED APPLICATIONS

This application is a continuation of U.S. application Ser. No. 11/675,415 filed Feb. 15, 2007, which issued as U.S. Pat. No. 8,093,200 on Jan. 10, 2012, the disclosure of which is hereby incorporated by reference in its entirety.

FIELD OF THE INVENTION

The invention is directed to solid detergent compositions, as for example, ware and/or hard surface cleaning compositions, rinse aids, sanitizing additives, laundry detergents and conveyor lubricants, that include a cleaning agent, branched fatty acid disintegrator for rapid dissolution, and additive agents such as detergent adjuvants as desired.

BACKGROUND OF THE INVENTION

Solid alkaline detergent compositions are widely used for household and industrial dishwashing, laundering clothing and general surface cleansing. The greater amount of such cleaning compositions consumed consists of solid granules, tablets or pellets and solid blocks. Solid compositions are advantageous for their improved handling and safety, elimination of component segregation during transportation and storage and increased concentration of active components within the composition. These detergent compositions typically incorporate a source of alkalinity such as an alkali metal hydroxide, carbonate, bicarbonate, silicate or mixtures thereof and a hardness sequestering agent or builder as their primary cleaning components. The hardness sequestering agent acts to condition the wash water by chelating or otherwise complexing the metal cations responsible for the precipitation of alkali metal builder salts and detergents. The alkaline components impart detergency to the compositions by breaking down acidic and proteinaceous soils.

The solid detergents are typically used by dissolving the solid detergent with water. For example laundry applications may use a water spray-on dispenser. In the dispenser, the detergent is combined with a major proportion of water producing a detergent concentrate solution that is added to wash water in a washing machine to form a wash solution. In other applications, the detergent concentrate solution is used directly, commonly referred to as a use solution. The use solution or wash solution, when contacted with a soiled article, successfully removes the soil from the article. Such detergency (soil removal) is most commonly obtained from a source of alkalinity used in manufacturing the detergent. In particular, U.S. Pat. Nos. 4,595,520, 4,680,134, 6,177,392, and 6,150,324 illustrate the use of solid technologies for a variety of applications.

In order to be effective for these applications it is necessary that the components of the solid detergent dissolves readily in the aqueous medium which is employed and the components are stable in the detergent concentrate solution and use solution. The present invention is directed to novel compositions and methods to improve the dissolution rate of tablets and blocks as well as enhance the cleaning ability of the solubilized solid detergent composition.

SUMMARY

The present invention includes a solid detergent composition that dissolves more quickly into a use solution than other solid compositions of similar composition, as well as having an enhanced cleaning ability. The present invention discloses the use of a branched fatty acid disintegrator in solid detergent compositions which enhances for the dissolution rate of the solid. In addition, use of branched fatty acid disintegrator improves the detersive action of the use solution.

DETAILED DESCRIPTION OF THE INVENTION

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

Weight percent, percent by weight, wt %, wt-%, % by weight, and the like are synonyms that refer to the concentration of a substance as the weight of that substance divided by the weight of the composition and multiplied by 100. As used in this application, the term "wt. %" refers to the weight percent of the indicated component relative to the total weight of the solid detergent composition, unless indicated differently. The weight percentage of an individual component does not include any water supplied with that component, even if the component is supplied as an aqueous solution or in a liquid premix, unless otherwise specified.

The recitation of numerical ranges by endpoints includes all numbers within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

A solid detergent composition according to the present disclosure is fast-dissolving. Typically, a solid detergent composition as disclosed herein dissolves quickly and completely upon contact with aqueous solution into a stable use solution. A stable use solution does not contain any solids upon visual inspection.

A solid detergent composition includes an effective amount of cleaning agent and an alkaline source to provide soil removal, solidification agent for binding the composition, and branched fatty acid disintegrator to provide improved dissolution of the solid detergent composition into aqueous use solution. The cleaning agent can include any component that provides soil removal properties when dispersed or dissolved in an aqueous solution and applied to a substrate for removal of soil from the substrate. The cleaning agent typically includes at least one surfactant, and a source of alkalinity. In certain embodiments, the cleaning agent preferably includes a surfactant or surfactant system, a source of alkalinity, a water conditioning agent, and an enzyme. In some embodiments, the solidification agent is inorganic in nature and optionally may also act as a source of alkalinity. In certain embodiments, the solidification agent includes sodium hydroxide, sodium carbonate or ash, and sodium metasilicate, or combinations thereof.

A solid detergent composition according to the present disclosure encompasses a variety of cast or extruded forms including, for example, solids, pellets, blocks, and tablets, but not powders. It should be understood that the term "solid" refers to the state of the detergent composition under the expected conditions of storage and use of the solid detergent composition. In general, it is expected that the detergent composition will remain a solid when provided at a temperature of up to about 100° F. and preferably greater than 120° F.

In certain embodiments, the solid detergent composition is provided in the form of a unit dose. A unit dose refers to a solid detergent composition unit sized so that the entire unit is used during a single washing cycle. When the solid detergent composition is provided as a unit dose, it is preferably provided as a cast solid, an extruded pellet, or a tablet having a size of between about 1 gram and about 50 grams. In other embodiments, a cast solid, an extruded pellet, or a tablet having a size of between 50 grams up through 250 grams, or an extruded solid with a weight of about 100 grams or greater. Furthermore, it should be appreciated that the solid detergent composition can be provided as a cast solid, an extruded pellet, or a tablet so that a plurality of the solids will be available in a package having a size of between about 40 grams and about 11,000 grams.

In other embodiments, the solid detergent composition is provided in the form of a multiple-use solid, such as, a block or a plurality of pellets, and can be repeatedly used to generate aqueous detergent compositions for multiple washing cycles. In certain embodiments, the solid detergent composition is provided as a cast solid, an extruded block, or a tablet having a mass of between about 5 grams and 10 kilograms. In certain embodiments, a multiple-use form of the solid detergent composition has a mass between about 1 and 10 kilograms. In further embodiments, a multiple-use form of the solid detergent composition has a mass of between about 5 kilograms and about 8 kilograms. In other embodiments, a multiple-use form of the solid detergent composition has a mass of between about 5 grams and about 1 kilogram, or between about 5 grams and about 500 grams.

Branched Fatty Acid Disintegrator

The solid detergent composition in the present invention includes a branched fatty acid disintegrator. A branched fatty acid disintegrator is defined herein as an additive to a solid detergent product which improves the dissolution rate of the solid product. In addition the branched fatty acid disintegrator can enhance the cleaning ability of the solid product by lowering the surface tension of the aqueous use solution to allow better penetration of the use solution into the soil and act as a hydrotrope to stabilize the solid detergent composition and the use solution.

Branched fatty acid disintegrators useful in the present invention include $C_5$ to $C_{20}$ branched fatty acids and salts thereof. Representative branched structures can be described as iso-, neo-, sec- or tert-. In many embodiments, the branched fatty acid disintegrators are saturated $C_5$ to $C_{18}$ fatty acids which include one or more alkyl branches off the main alkyl chain. In certain embodiments, the branched fatty acid disintegrators are saturated $C_5$ to $C_{18}$ fatty acids which include one or two methyl branches off the main alkyl chain. In certain embodiments, the branched fatty acid disintegrators are represented by the formula $CH_3(CH_2)_m(CH)_n(CH_2)_o(CH)_p(CH_2)_q$ COOH wherein m, n, o, p and q are each an integer selected from 0-17, and n+p is 1 or 2, and m+n+o+p+q is between 3 and 18. In some embodiments, the branched fatty acid disintegrators are salts of branched fatty acids of the above formula. In certain embodiments, $CH_3(CH_2)_m(CH)_n(CH_2)_o(CH)_p(CH_2)_q$ COOH wherein m, n, o, p and q are each an integer selected from 0-17, and n+p is 1 or 2, and m+n+o+p+q is between 6 and 12. Examples of suitable branched fatty acid disintegrators are sodium isononanoate, isononanoic acid, sodium isooctanoate, isooctanoic acid, sodium neodecanote, neodecanoic acid, sodium neopentanoate, neopentanoic acid, sodium neoheptanote, neoheptanoic acid, any of the acids shown below and salts thereof, or mixtures thereof.

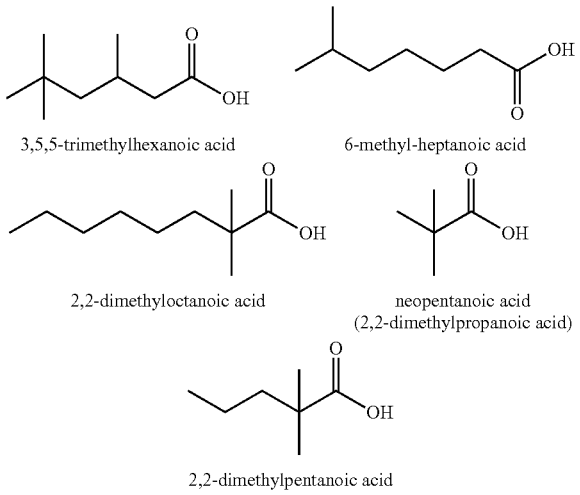

The solid detergent composition in the present invention includes at least 0.2 weight % of branched fatty acid disintegrator. In certain embodiments, the solid detergent composition includes between 0.2 wt. %-5 wt. % of branched fatty acid disintegrator. In other embodiments, the solid detergent composition includes between 0.2 wt %-20 wt. % of branched fatty acid disintegrator. Greater amounts of branched fatty acid disintegrator, for example >5 wt. % are useful in solid detergent compositions where the branched fatty acid disintegrator also functions as a hydrotrope, surfactant and/or detersive component.

Organic Detergents, Surfactants or Cleaning Agents

The composition can include at least one cleaning agent that is preferably a surfactant or surfactant system. The term "surfactant system" refers to a mixture of at least two surfactants. A variety of surfactants can be used in a solid detergent composition, including anionic, nonionic, cationic, and zwitterionic surfactants.

Exemplary surfactants that can be used are commercially available from a number of sources. For a discussion of surfactants, see Kirk-Othmer, Encyclopedia of Chemical Technology, Third Edition, volume 8, pages 900 912, the disclosure of surfactants being incorporated herein by reference. When the solid detergent composition includes a cleaning agent, the cleaning agent can be provided in an amount effective to provide a desired level of cleaning.

In certain embodiments, the solid detergent composition includes a surfactant or surfactant system in an amount effective to provide a desired level of cleaning. Preferably, solid detergent composition contains about 0 40 wt. %, and more preferably about 1 wt. % to about 20 wt. % of the surfactant or surfactant system.

Anionic surfactants useful in the present solid detergent compositions, include, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Preferred anionics are sodium alkylarylsulfonate, alpha-olefinsulfonate, and fatty alcohol sulfates.

When the solid detergent composition includes an anionic surfactant, the anionic surfactant is preferably provided in an amount of greater than about 0.1 wt. % and up to about 40 wt. %.

Nonionic surfactants useful in solid detergent compositions include those having a polyalkylene oxide polymer as a portion of the surfactant molecule. Such nonionic surfactants include, for example, chlorine-, benzyl-, methyl-, ethyl-, propyl-, butyl- and other alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC (BASF-Wyandotte), and the like; and other like nonionic compounds. Silicone surfactants such as the ABIL B8852 can also be used.

When the solid detergent composition includes a nonionic surfactant, the nonionic surfactant is preferably provided in an amount of greater than about 0.1 wt. % and up to about 20 wt. %.

Cationic surfactants useful for inclusion in a cleaning composition for sanitizing or fabric softening, include amines such as primary, secondary and tertiary monoamines with $C_{1-8}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$ $C_{18}$)dimethylbenzyl ammonium chloride, n-tetradecyldimethylbenzylammonium chloride monohydrate, a naphthalene-substituted quaternary ammonium chloride such as dimethyl-1-naphthylmethylammonium chloride, and the like; and other like cationic surfactants.

When the solid detergent composition includes a cationic surfactant, the cationic surfactant is preferably provided in an amount of greater than about 0.1 wt. % and up to about 20 wt. %.

Zwitterionic surfactants that can be used in the solid detergent composition include betaines, imidazolines, and propionates. Because the solid detergent composition may be intended to be used in an automatic dishwashing or warewashing, or clotheswashing machine, the surfactants selected, if any surfactant is used, can be those that provide an acceptable level of foaming when used inside a dishwashing or warewashing machine. It should be understood that solid detergent compositions for use in automatic dishwashing or warewashing machines are generally considered to be low-foaming compositions.

The surfactant can be selected to provide low foaming properties. One would understand that low foaming surfactants that provide the desired level of detersive activity are advantageous in an environment such as a dishwashing machine where the presence of large amounts of foaming can be problematic. In addition to selecting low foaming surfactants, one would understand that defoaming agents can be utilized to reduce the generation of foam. Accordingly, surfactants that are considered low foaming surfactants as well as other surfactants can be used in the solid detergent composition and the level of foaming can be controlled by the addition of a defoaming agent.

The solid detergent composition includes the surfactant or surfactant system in a range of about 0.05 wt. % to about 20 wt. %, about 0.5 wt. % to about 15 wt. %, about 1 wt. % to about 15 wt. %, about 1.5 wt. % to about 10 wt. %, and about 2 wt. % to about 5 wt. %. Additional exemplary ranges of surfactant in a concentrate include about 0.5 wt. % to about 5 wt. %, and about 1 wt. % to about 3 wt. %.

Inorganic Detergents or Alkaline Sources

The solid detergent composition according to the invention includes an effective amount of one or more alkaline sources to enhance cleaning of a substrate and improve soil removal performance of the composition. In general, an effective amount of one or more alkaline sources should be considered as an amount that provides a use composition having a pH of at least about 8. When the use composition has a pH of between about 8 and about 10, it can be considered mildly alkaline, and when the pH is greater than about 12, the use composition can be considered caustic. In general, it is desirable to provide the use composition as a mildly alkaline cleaning composition because it is considered to be more safe than the caustic based use compositions.

The solid detergent composition can include an alkali metal carbonate and/or an alkali metal hydroxide. Exemplary metal carbonates that can be used include, for example, sodium or potassium carbonate, bicarbonate, sesquicarbonate, mixtures thereof. Exemplary alkali metal hydroxides that can be used include, for example, sodium or potassium hydroxide. An alkali metal hydroxide may be added to the composition in the form of solid beads, dissolved in an aqueous solution, or a combination thereof. Alkali metal hydroxides are commercially available as a solid in the form of prilled solids or beads having a mix of particle sizes ranging from about 12-100 U.S. mesh, or as an aqueous solution, as for example, as a 50 wt. % and a 73 wt. % solution.

The solid detergent composition can include a sufficient amount of the alkaline source to provide the use composition with a pH of at least about 8. The source of alkalinity is preferably in an amount to enhance the cleaning of a substrate and improve soil removal performance of the composition. In general, it is expected that the concentrate will include the alkaline source in an amount of at least about 5 wt. %, at least about 10 wt. %, or at least about 15 wt. %. The solid detergent composition can include between about 10 wt. % and about 80 wt. %, preferably between about 15 wt. % and about 70 wt. %, and even more preferably between about 20 wt. % and about 60 wt. % of the source of alkalinity. The source of alkalinity can additionally be provided in an amount to neutralize the anionic surfactant and may be used to assist in the solidification of the composition.

In order to provide sufficient room for other components in the concentrate, the alkaline source can be provided in the concentrate in an amount of less than about 60 wt. %. In addition, the alkaline source can be provided at a level of less than about 40 wt. %, less than about 30 wt. %, or less than about 20 wt. %. In certain embodiments, it is expected that the solid detergent composition may provide a use composition that is useful at pH levels below about 8. In such compositions, an alkaline source may be omitted, and additional pH adjusting agents may be used to provide the use composition with the desired pH. Accordingly, it should be understood that the source of alkalinity can be characterized as an optional component.

In some embodiments, the solidification agent is inorganic in nature and optionally may also act as a source of alkalinity. In certain embodiments, the solidification agent includes sodium hydroxide, sodium carbonate or ash, and sodium metasilicate, or combinations thereof.

Solidification Agent

The solidification agent is preferably provided dispersed throughout the solid detergent composition to bind the detergent composition together to provide a solid detergent composition. Solidification agents may also be called solidification agents and encompass hardening agents, such as PEG. The binding agent according to the invention can be used as the primary binding agent or as a secondary binding agent of the solid detergent forming composition. The term "primary binding agent" refers to the binding agent that is the primary source for causing the solidification of the detergent composition. The term "secondary binding agent" refers to the binding agent that acts as an auxiliary binding agent in combination with another primary binding agent. The secondary binding agent can be used to enhance solidification of the detergent composition and/or help accelerate the solidification of the detergent composition. Using the binding agent component of the invention as a secondary binding agent component is useful when the primary binding agent component does not solidify the detergent composition at a desired rate. Accordingly, the secondary binding agent component can be used to help accelerate the solidification process.

The solid detergent composition is preferably prepared by providing a composition containing between about 10 wt. % and about 80 wt. % binding agent, or between about 1 wt. % and about 40 wt. % binding agent, and sufficient water to provide necessary hydration for solidification. In certain embodiments, the binding agent may also serve as an alkaline source.

The following patents disclose various combinations of solidification, binding and/or hardening agents and methods for solidification that may be utilized in the solid detergent compositions of the present invention. The following U.S. patents are incorporated herein by reference: U.S. Pat. Nos. 7,153,820; 7,094,746; 7,087,569; 7,037,886; 6,831,054; 6,730,653; 6,660,707; 6,653,266; 6,583,094; 6,410,495; 6,258,765; 6,177,392; 6,156,715; 5,858,299; 5,316,688; 5,234,615; 5,198,198; 5,078,301; 4,595,520; 4,680,134; RE32,763; and RE32818.

In certain embodiments, a solid detergent composition includes about 10 to 80 wt % of sodium carbonate ($Na_2CO_3$), sodium hydroxide (NaOH), or sodium metasilicate, or combinations thereof, for solidification of the solid composition. The solid detergent composition may also include an effective amount of an organic phosphonate hardness sequestering agent comprising a potassium salt. In certain embodiments, a solid detergent composition includes about 10 to 40 wt % of sodium carbonate, in further embodiments 20 to 40 wt % sodium carbonate. In certain further embodiments, a solid detergent composition includes about 20 to 40 wt % sodium carbonate and 15 to 40 wt % sodium hydroxide.

In some embodiments, solid detergent compositions including a substantial portion of sodium hydroxide are cast and solidified. For example, sodium hydroxide hydrate can be used solidify a cast material in a freezing process using the low melting point of sodium hydroxide monohydrate (about 50° C.-65° C.). The active components of the detergent were mixed with the molten sodium hydroxide and cooled to solidify. The resulting solid was a matrix of hydrated solid sodium hydroxide with the detergent ingredients dissolved or suspended in the hydrated matrix. In this prior art cast solid and other prior art hydrated solids, the hydrated chemicals are reacted with water and the hydration reaction is run to substantial completion. The sodium hydroxide also provided substantial cleaning in warewashing systems and in other use loci that require rapid and complete soil removal. In these early products sodium hydroxide was an ideal candidate because of the highly alkaline nature of the caustic material provided excellent cleaning. Cast solids may also be formed using a combination of sodium hydroxide and sodium carbonate. Certain embodiments contain at least 30% by weight of an alkali metal hydroxide in combination with water of hydration. Further embodiments, contain 30 to 50% by weight of an alkali metal hydroxide.

In other embodiments, the binding agent is formed by mixing alkali metal carbonate, alkali metal bicarbonate, and water. In certain embodiments alkali metal carbonate includes soda ash or sodium carbonate. In certain embodiments, the alkali metal bicarbonate includes sodium bicarbonate. The alkali metal bicarbonate component can be provided by adding alkali metal bicarbonate or by forming alkali metal bicarbonate in situ. The alkali metal bicarbonate can be formed in situ by reacting the alkali metal carbonate with an acid. The amounts of alkali metal carbonate, alkali metal bicarbonate, and water can be adjusted to control the rate of solidification of the detergent composition and to control the pH of aqueous detergent composition obtained from the solid detergent composition. The rate of solidification of the detergent composition can be increased by increasing the ratio of alkali metal bicarbonate to alkali metal carbonate, or decreased by decreasing the ratio of alkali metal bicarbonate to alkali metal carbonate.

In certain embodiments, the solid detergent composition contains between about 10 wt. % and about 80 wt. % alkali metal carbonate, between about 1 wt. % and about 40 wt. % alkali metal bicarbonate, and sufficient water to provide at least a monohydrate of carbonate and a monohydrate of bicarbonate.

In other embodiments, solidification agent of the solid detergent composition includes alkaline carbonate, water and a sequestering agent. For example, the composition includes an alkali metal salt of an organophosphonate at 1-30 wt %, preferably 3-15 wt % of a potassium salt; and water at 5-15 wt %, preferably 5 12 wt %; and Alkali Metal carbonate 25 80 wt %; preferably 30 55 wt %. A single E-form hydrate binder composition forms as this material solidifies. The solid detergent comprises a major proportion of carbonate monohydrate, a portion of non-hydrated (substantially anhydrous) alkali metal carbonate and the E-form binder composition comprising a fraction of the carbonate material, an amount of the organophosphonate and water of hydration.

In yet other embodiments, the solidification agent includes an effective amount of one or more anhydrous salts, which are selected to hydrate and melt at a temperature below that at which significant phosphate reversion occurs. Such temperatures typically fall within the range of about 33°-65° C., preferably salts which melt at about 35°-50° C. will be used. The dispersed, hydrated salt solidifies when the emulsion is cooled and can bind sufficient free water to afford a stable, homogeneous solid at ambient temperatures, e.g., at about 15°-25° C. Preferably an amount of anhydrous sodium carbonate, anhydrous sodium sulfate or mixtures thereof effective to solidify the composition when they are cooled to ambient temperatures will be employed. The amount of solidifying agent is related to the percentage of water present in the composition as well as the hydration capacity of the other detergent components. For example, prior to solidification, preferred liquid detergent emulsions will comprise about 45 to 75% solids, most preferably about 55 to 70% solids and about 25 to 55%, most preferably about 30-45% water.

Water

A solid detergent composition can include water. Water may be independently added to the detergent composition or may be provided in the detergent composition as a result of its presence in an aqueous material that is added to the detergent composition. For example, many of the materials added to the detergent composition include water available for reaction with the solidification agent component(s). Typically, water is introduced into the detergent composition to provide the detergent composition with a desired viscosity prior to solidification, and to provide a desired rate of solidification.

In general, it is expected that water is present as a processing aid and may be removed or become water of hydration. It is expected that water may be present in the solid composition. In certain embodiments of solid detergent composition, water may be present in ranges of between about 0 wt. % to about 10 wt. %, about 0.1 wt. % to about 10 wt. %, about 1 wt. % to about 5 wt. %, and about 2 wt. % to about 3 wt. %. In other embodiments of solid detergent compositions, it is expected that the water will be present in the ranges of between about 25 wt. % to about 40 wt. %, about 27 wt. % to about 35 wt. %, and 29 wt. % to about 31 wt. %. It should be additionally appreciated that the water may be provided as deionized water or as softened water.

The components used to form the solid composition can include water as hydrates or hydrated forms of the binding agent, hydrates or hydrated forms of any of the other ingredients, and/or added aqueous medium as an aid in processing. It is expected that the aqueous medium will help provide the components with a desired viscosity for processing. In addition, it is expected that the aqueous medium may help in the solidification process when is desired to form the concentrate as a solid. When the concentrate is provided as a solid, it can be provided in the form of a block or pellet. It is expected that blocks will have a size of at least about 5 grams, and can include a size of greater than about 50 grams. It is expected that the concentrate will include water in an amount of between about 1 wt. % and about 50 wt. %, and between about 2 wt. % and about 40 wt. %.

When the components that are processed to form the concentrate are processed into a block, it is expected that the components can be processed by extrusion techniques or casting techniques. In general, when the components are processed by extrusion techniques, it is believed that the composition can include a relatively smaller amount of water as an aid for processing compared with the casting techniques. In general, when preparing the solid by extrusion, it is expected that the composition can contain between about 2 wt. % and about 10 wt. % water. When preparing the solid by casting, it is expected that the amount of water can be provided in an amount of between about 20 wt. % and about 40 wt. %.

Additional Functional Materials

As indicated above, the solid detergent composition that may contain other functional materials that provide the desired properties and functionality to the solid composition. For the purpose of this application, the term "functional materials" include a material that when dispersed or dissolved in a use and/or concentrate solution, such as an aqueous solution, provides a beneficial property in a particular use. Examples of such a functional material include chelating/sequestering agents; inorganic detergents or alkaline sources; organic detergents, surfactants or cleaning agents; rinse aids; bleaching agents; sanitizers/anti-microbial agents; activators; detergent builders or fillers; defoaming agents, anti-redeposition agents; optical brighteners; dyes/odorants; secondary hardening agents/solubility modifiers; pesticides and/or baits for pest control applications; or the like, or a broad variety of other functional materials, depending upon the desired characteristics and/or functionality of the composition. In the context of some embodiments disclosed herein, the functional materials, or ingredients, are optionally included within the solidification matrix for their functional properties. The binding agent acts to bind the matrix, including the functional materials, together to form the solid composition. Some more particular examples of functional materials are discussed in more detail below, but it should be understood by those of skill in the art and others that the particular materials discussed are given by way of example only, and that a broad variety of other functional materials may be used.

Solidification Agent

The solidification agent is preferably provided dispersed throughout the solid detergent composition to bind the detergent composition together to provide a solid detergent composition. Solidification agents may also be called solidification agents and encompass hardening agents, such as PEG. The binding agent according to the invention can be used as the primary binding agent or as a secondary binding agent of the solid detergent forming composition. The term "primary binding agent" refers to the binding agent that is the primary source for causing the solidification of the detergent composition. The term "secondary binding agent" refers to the binding agent that acts as an auxiliary binding agent in combination with another primary binding agent. The secondary binding agent can be used to enhance solidification of the detergent composition and/or help accelerate the solidification of the detergent composition. Using the binding agent component of the invention as a secondary binding agent component is useful when the primary binding agent component does not solidify the detergent composition at a desired rate. Accordingly, the secondary binding agent component can be used to help accelerate the solidification process.

The solid detergent composition is preferably prepared by providing a composition containing between about 10 wt. % and about 80 wt. % binding agent, or between about 1 wt. % and about 40 wt. % binding agent, and sufficient water to provide necessary hydration for solidification.

The following patents disclose various combinations of solidification, binding and/or hardening agents and methods for solidification that may be utilized in the solid detergent compositions of the present invention. The following U.S. patents are incorporated by reference herein: U.S. Pat. Nos. 7,153,820; 7,094,746; 7,087,569;7,037,886; 6,831,054; 6,730,653; 6,660,707; 6,653,266; 6,583,094; 6,410,495; 6,258,765; 6,177,392; 6,156,715; 5,858,299; 5,316,688; 5,234,615; 5,198,198; 5,078,301; 4,595,520; 4,680,134; RE32,763; and RE32818.

In some embodiments, solid detergent compositions including a substantial portion of sodium hydroxide are cast and solidified. For example, sodium hydroxide hydrate can be used solidify a cast material in a freezing process using the low melting point of sodium hydroxide monohydrate (about 50° C.-65° C.). The active components of the detergent were mixed with the molten sodium hydroxide and cooled to solidify. The resulting solid was a matrix of hydrated solid sodium hydroxide with the detergent ingredients dissolved or suspended in the hydrated matrix. In this prior art cast solid and other prior art hydrated solids, the hydrated chemicals are reacted with water and the hydration reaction is run to substantial completion. The sodium hydroxide also provided substantial cleaning in warewashing systems and in other use loci that require rapid and complete soil removal. In these early products sodium hydroxide was an ideal candidate because of the highly alkaline nature of the caustic material provided excellent cleaning. Cast solids may also be formed using a combination of sodium hydroxide and sodium carbonate.

In other embodiments, the binding agent is formed by mixing alkali metal carbonate, alkali metal bicarbonate, and water. In certain embodiments alkali metal carbonate includes soda ash or sodium carbonate. In certain embodiments, the alkali metal bicarbonate includes sodium bicarbonate. The alkali metal bicarbonate component can be provided by adding alkali metal bicarbonate or by forming alkali metal bicarbonate in situ. The alkali metal bicarbonate can be formed in situ by reacting the alkali metal carbonate with an acid. The amounts of alkali metal carbonate, alkali metal bicarbonate, and water can be adjusted to control the rate of solidification of the detergent composition and to control the pH of aqueous detergent composition obtained from the solid detergent composition. The rate of solidification of the detergent composition can be increased by increasing the ratio of alkali metal bicarbonate to alkali metal carbonate, or decreased by decreasing the ratio of alkali metal bicarbonate to alkali metal carbonate. The aqueous detergent composition that is used for cleaning a substrate can be referred to as the use solution.

The pH of the use solution can be controlled by adjusting the source of alkalinity component and/or the amount of the alkali metal carbonate and alkali metal bicarbonate components. In general, it is expected that the pH of the desired detergent use solution will be between about 8 and about 12, and more preferably between about 8 and about 11, and even more preferably between about 9 and about 10.5.

The alkali metal bicarbonate component can be added to the solid detergent forming composition or it can be generated in situ by reaction of alkali metal carbonate and acid. The acid that can be added to form the alkali metal bicarbonate is preferably any acid that will react with the alkali metal carbonate to form the alkali metal bicarbonate. The acid can be provided as an organic acid or as an inorganic acid, and as a solid or as a liquid. Preferred acids that can be used include citric acid, sulfamic acid, adipic acid, succinic acid, and sulfonic acid.

The amount of acid provided to form the alkali bicarbonate is preferably provided in an amount that does not cause over neutralization of the alkali metal carbonate. That is, it is desirable for the acid to react with the alkali metal carbonate to a degree sufficient to form alkali metal bicarbonate. It is generally undesirable for the acid to continue reacting to form carbonic acid. Although the reaction between the acid and the alkali metal carbonate may form some carbonic acid, it is generally understood that the formation of carbonic acid results in wasted alkali metal carbonate and acid.

Water may be independently added to the detergent composition or may be provided in the detergent composition as a result of its presence in an aqueous material that is added to the detergent composition. For example, many of the materials added to the detergent composition include water available for reaction with the alkali metal carbonate and alkali metal bicarbonate components. For purposes of this discussion, the reference to water content refers to the presence of water available for reaction with the alkali metal carbonate and the alkali metal bicarbonate components. Preferably, water is introduced into the detergent composition to provide the detergent composition with a desired viscosity prior to solidification, and to provide a desired rate of solidification.

The solid detergent composition is preferably prepared by providing a composition containing between about 10 wt. % and about 80 wt. % alkali metal carbonate, between about 1 wt. % and about 40 wt. % alkali metal bicarbonate, and sufficient water to provide at least a monohydrate of carbonate and a monohydrate of bicarbonate.

Water

The solid detergent composition can include water. In general, it is expected that water may be present as a processing aid and may be removed or become water of hydration. It is expected that water may be present in the solid composition. In the solid composition, it is expected that the water will be present in ranges of between about 0 wt. % and about 10 wt. %, about 0.1 wt. % and about 10 wt. %, about 1 wt. % and about 5 wt. %, and about 2 wt. % and about 3 wt. %. Alternatively, in another solid composition, it is expected that the water will be present in the ranges of between about 25 wt. % and about 35 wt. %, about 27 wt. % and about 33 wt. %, and 29 wt. % and about 31 wt. %. It should be additionally appreciated that the water may be provided as deionized water or as softened water.

The components used to form the solid composition can include water as hydrates or hydrated forms of the binding agent, hydrates or hydrated forms of any of the other ingredients, and/or added aqueous medium as an aid in processing. It is expected that the aqueous medium will help provide the components with a desired viscosity for processing. In addition, it is expected that the aqueous medium may help in the solidification process when is desired to form the concentrate as a solid. When the concentrate is provided as a solid, it can be provided in the form of a block or pellet. It is expected that blocks will have a size of at least about 5 grams, and can include a size of greater than about 50 grams. It is expected that the concentrate will include water in an amount of between about 1 wt. % and about 50 wt. %, and between about 2 wt. % and about 40 wt. %.

When the components that are processed to form the concentrate are processed into a block, it is expected that the components can be processed by extrusion techniques or casting techniques. In general, when the components are processed by extrusion techniques, it is believed that the composition can include a relatively smaller amount of water as an aid for processing compared with the casting techniques. In general, when preparing the solid by extrusion, it is expected that the composition can contain between about 2 wt. % and about 10 wt. % water. When preparing the solid by casting, it is expected that the amount of water can be provided in an amount of between about 20 wt. % and about 40 wt. %.

Water Conditioning Agent

The water conditioning agent can be referred to as a detergent builder and/or chelating agent and generally provides cleaning properties and chelating properties. Exemplary detergent builders include sodium sulphate, sodium chloride, starch, sugars, $C_1$ $C_{10}$ alkylene glycols such as propylene glycol, and the like. Exemplary chelating agents include phosphates, phosphonates, and amino-carboxylates. Exemplary phosphates include sodium orthophosphate, potassium orthophosphate, sodium pyrophosphate, potassium pyrophosphate, sodium tripolyphosphate (STPP), and sodium hexametaphosphate. Exemplary phosphonates include 1-hydroxyethane-1,1-diphosphonic acid, aminotrimethylene phosphoric acid, diethylenetriaminepenta(methylenephosphonic acid), 1-hydroxyethane-1,1-diphosphonic acid $CH_3C(OH)[PO(OH)_2]_2$, aminotri(methylenephosphonic acid) $N[CH_2PO(OH)_2]_3$, aminotri(methylenephosphonate), 2-hydroxyethyliminobis (methylenephosphonic acid) $HOCH_2CH_2N[CH_2PO(OH)_2]_2$, diethylenetriamine penta(m-ethylenephosphonic acid) $(HO)_2POCH_2N[CH_2CH_2N[CH_2PO(OH)_2]_2]_{-2}$, diethylenetriaminepenta(methylenephosphonate), sodium salt $C_9H_{(28-x)}N_3Na_xO_{15}P_5$ (x=7), hexamethylenediamine(tetramethylenephosphonate), potassium salt $C_{10}H_{(28-x)}N_2K_xO_{12}P_4$ (x=6), bis(hexamethylene) triamine(pentamethylenephosphonic acid) $(HO_2)POCH_2N[(CH_2)_6N[CH_2PO(OH)_2]_2]_{-2}$, and phosphorus acid $H_3PO_3$. Exemplary amino-carboxylates include aminocarboxylic acids such as N-hydroxyethylimino diacetic acid, nitrilotriacetic acid (NTA), ethylenediaminetetraacetic acid (EDTA), N-hydroxyethyl-ethylenediaminetriacetic acid (DTPA).

Preferably, the water conditioning agent, when it is used, is provided in an amount of between about 1 wt. % of about 50 wt. %, and preferably between about 3 wt. % and 35 wt. %.

Enzyme

Enzymes that can be used according to the invention include enzymes that provide desirable activity for removal of protein-based, carbohydrate-based, or triglyceride-based stains from substrates; for cleaning, destaining, and sanitizing presoaks, such as presoaks for medical and dental instruments, devices, and equipment; presoaks for flatware, cooking ware, and table ware; or presoaks for meat cutting equipment; for machine warewashing; for laundry and textile cleaning and destaining;

for carpet cleaning and destaining; for cleaning-in-place and destaining-in-place; for cleaning and destaining food processing surfaces and equipment; for drain cleaning; presoaks for cleaning; and the like. Although not limiting to the present invention, enzymes suitable for the solid detergent compositions can act by degrading or altering one or more types of soil residues encountered on an instrument or device thus removing the soil or making the soil more removable by a surfactant or other component of the cleaning composition. Both degradation and alteration of soil residues can improve detergency by reducing the physicochemical forces that bind the soil to the instrument or device being cleaned, i.e. the soil becomes more water soluble. For example, one or more proteases can cleave complex, macromolecular protein structures present in soil residues into simpler short chain molecules which are, of themselves, more readily desorbed from surfaces, solubilized or otherwise more easily removed by detersive solutions containing said proteases.

Suitable enzymes include a protease, an amylase, a lipase, a gluconase, a cellulase, a peroxidase, or a mixture thereof of any suitable origin, such as vegetable, animal, bacterial, fungal or yeast origin. Preferred selections are influenced by factors such as pH-activity and/or stability optima, thermo stability, and stability to active detergents, builders and the like. In this respect bacterial or fungal enzymes are preferred, such as bacterial amylases and proteases, and fungal cellulases. Preferably the enzyme is a protease, a lipase, an amylase, or a combination thereof.

"Detersive enzyme", as used herein, means an enzyme having a cleaning, destaining or otherwise beneficial effect as a component of a solid detergent composition for instruments, devices, or equipment, such as medical or dental instruments, devices, or equipment; or for laundry, textiles, warewashing, cleaning-in-place, drains, carpets, meat cutting tools, hard surfaces, personal care, or the like. Preferred detersive enzymes include a hydrolase such as a protease, an amylase, a lipase, or a combination thereof. Preferred enzymes in solid detergent compositions for cleaning medical or dental devices or instruments include a protease, an amylase, a cellulase, a lipase, or a combination thereof. Preferred enzymes in solid detergent compositions for food processing surfaces and equipment include a protease, a lipase, an amylase, a gluconase, or a combination thereof. Preferred enzymes in solid detergent compositions for laundry or textiles include a protease, a cellulase, a lipase, a peroxidase, or a combination thereof. Preferred enzymes in solid detergent compositions for carpets include a protease, an amylase, or a combination thereof. Preferred enzymes in solid detergent compositions for meat cutting tools include a protease, a lipase, or a combination thereof. Preferred enzymes in solid detergent compositions for hard surfaces include a protease, a lipase, an amylase, or a combination thereof. Preferred enzymes in solid detergent compositions for drains include a protease, a lipase, an amylase, or a combination thereof.

Enzymes are normally incorporated into a solid detergent composition according to the invention in an amount sufficient to yield effective cleaning during a washing or presoaking procedure. An amount effective for cleaning refers to an amount that produces a clean, sanitary, and, preferably, corrosion free appearance to the material cleaned, particularly for medical or dental devices or instruments. An amount effective for cleaning also can refer to an amount that produces a cleaning, stain removal, soil removal, whitening, deodorizing, or freshness improving effect on substrates such as medical or dental devices or instruments and the like. Such a cleaning effect can be achieved with amounts of enzyme as low as about 0.1 wt-% of the solid detergent composition. In the cleaning compositions of the present invention, suitable cleaning can typically be achieved when an enzyme is present at about 1 to about 30 wt-%; preferably about 2 to about 15 wt-%; preferably about 3 to about 10 wt-%; preferably about 4 to about 8 wt-%; preferably about 4, about 5, about 6, about 7, or about 8 wt-%. The higher enzyme levels are typically desirable in highly concentrated cleaning or presoak formulations. A presoak is preferably formulated for use upon a dilution of about 1:500, or to a formulation concentration of about 2000 to about 4000 ppm, which puts the use concentration of the enzyme at about 20 to about 40 ppm.

Commercial enzymes, such as alkaline proteases, are obtainable in liquid or dried form, are sold as raw aqueous solutions or in assorted purified, processed and compounded forms, and include about 2% to about 80% by weight active enzyme generally in combination with stabilizers, buffers, cofactors, impurities and inert vehicles. The actual active enzyme content depends upon the method of manufacture and is not critical; assuming the solid detergent composition has the desired enzymatic activity. The particular enzyme chosen for use in the process and products of this invention depends upon the conditions of final utility, including the physical product form, use pH, use temperature, and soil types to be degraded or altered. The enzyme can be chosen to provide optimum activity and stability for any given set of utility conditions.

The solid detergent compositions of the present invention preferably include at least a protease. The solid detergent composition of the invention has further been found, surprisingly, to significantly stabilize protease activity in use compositions toward digesting proteins and enhancing soil removal. Further, enhanced protease activity can occur in the presence of one or more additional enzymes, such as amylase, cellulase, lipase, peroxidase, endoglucanase enzymes and mixtures thereof, preferably lipase or amylase enzymes.

A valuable reference on enzymes is "Industrial Enzymes", Scott, D., in Kirk-Othmer Encyclopedia of Chemical Technology, 3rd Edition, (editors Grayson, M. and EcKroth, D.) Vol. 9, pp. 173 224, John Wiley & Sons, New York, 1980.

Protease

A protease suitable for the solid detergent composition of the present invention can be derived from a plant, an animal, or a microorganism. Preferably the protease is derived from a microorganism, such as a yeast, a mold, or a bacterium. Preferred proteases include serine proteases active at alkaline pH, preferably derived from a strain of *Bacillus* such as *Bacillus subtilis* or *Bacillus licheniformis*; these preferred proteases include native and recombinant subtilisins. The protease can be purified or a component of a microbial extract, and either wild type or variant (either chemical or recombinant). A preferred protease is neither inhibited by a metal chelating agent (sequestrant) or a thiol poison nor activated by metal ions or reducing agents, has a broad substrate specificity, is inhibited by diisopropylfluorophosphate (DFP), is an endopeptidase, has a molecular weight in the range of about 20,000 to about 40,000, and is active at a pH of about 6 to about 12 and at temperatures in a range from about 20° C. to about 80° C.

Examples of proteolytic enzymes which can be employed in the solid detergent composition of the invention include (with trade names) Savinase™; a protease derived from *Bacillus lentus* type, such as Maxacal™, Opticlean™ Durazym™, and Properase™; a protease derived from *Bacillus licheniformis*, such as Alcalase™, Maxatase™, Deterzyme™, or Deterzyme PAG 510/220; a protease derived from *Bacillus amyloliquefaciens*, such as Primase™; and a protease derived from *Bacillus alcalophilus*, such as Deterzyme APY. Preferred commercially available protease enzymes include those sold under the trade names Alcalase™, Savinase™ Primaset, Durazym(, or Esperase™ by Novo Industries A/S (Denmark); those sold under the trade names Maxatase™, Maxacal™, or Maxapem™ by Gist-Brocades (Netherlands); those sold under the trade names Purafect™, Purafect OX, and Properase by Genencor International; those sold under the trade names Opticlean™ or Optimase™ by Solvay Enzymes; those sold under the tradenames Deterzyme™, Deterzyme APY, and Deterzyme PAG 510/220 by Deerland Corporation, and the like.

A mixture of such proteases can also be used. For example, Purafect is a preferred alkaline protease (a subtilisin) for use in detergent compositions of this invention having application in lower temperature cleaning programs, from about 30° C. to about 65° C.; whereas, Esperase™ is an alkaline protease of choice for higher temperature detersive solutions, from about 50° C. to about 85° C.

Suitable detersive proteases are described in patent publications including: GB 1,243,784, WO 9203529 A (enzyme/inhibitor system), WO 9318140 A, and WO 9425583 (recombinant trypsin-like protease) to Novo; WO 9510591 A, WO 9507791 (a protease having decreased adsorption and increased hydrolysis), WO 95/30010, WO 95/30011, WO 95/29979, to Procter & Gamble; WO 95/10615 (*Bacillus amyloliquefaciens* subtilisin) to Genencor International; EP 130,756 A (protease A); EP 303,761 A (protease B); and EP 130,756 A. A variant protease employed in the present solid detergent compositions is preferably at least 80% homologous, preferably having at least 80% sequence identity, with the amino acid sequences of the proteases in these references.

In preferred embodiments of this invention, the amount of commercial alkaline protease present in the composition of the invention ranges from about 1 to about 30 wt-%; preferably about 2 to about 15 wt-%; preferably about 3 to about 10 wt-%; preferably about 4 to about 8 wt-%; preferably about 4, about 5, about 6, about 7, or about 8 wt-%. Typical commercially available detersive enzymes include about 5 10% of active enzyme.

Whereas establishing the percentage by weight of commercial alkaline protease required is of practical convenience for manufacturing embodiments of the present teaching, variance in commercial protease concentrates and in-situ environmental additive and negative effects upon protease activity require a more discerning analytical technique for protease assay to quantify enzyme activity and establish correlations to soil residue removal performance and to enzyme stability within the preferred solid embodiment and to use-dilution solutions. The activity of the proteases for use in the present invention are readily expressed in terms of activity units—more specifically, Kilo-Novo Protease Units (KNPU) which are azocasein assay activity units well known to the art. A more detailed discussion of the azocasein assay procedure can be found in the publication entitled "The Use of Azoalbumin as a Substrate in the Colorimetric Determination of Peptic and Tryptic Activity", Tomarelli, R. M., Charney, J., and Harding, M. L., J. Lab. Clin. Chem. 34, 428 (1949).

In preferred embodiments of the present invention, the activity of proteases present in the use-solution ranges from about 1.times.$10^{-5}$ KNPU/gm solution to about 4.times.$10^{-3}$ KNPU/gm solution.

Naturally, mixtures of different proteolytic enzymes may be incorporated into this invention. While various specific enzymes have been described above, it is to be understood that any protease which can confer the desired proteolytic activity to the composition may be used and this embodiment of this invention is not limited in any way by specific choice of proteolytic enzyme.

Amylase

An amylase suitable for the solid detergent composition of the present invention can be derived from a plant, an animal, or a microorganism. Preferably the amylase is derived from a microorganism, such as a yeast, a mold, or a bacterium. Preferred amylases include those derived from a *Bacillus*, such as *B. licheniformis, B. amyloliquefaciens, B. subtilis*, or *B. stearothermophilus*. The amylase can be purified or a component of a microbial extract, and either wild type or variant (either chemical or recombinant), preferably a variant that is more stable under washing or presoak conditions than a wild type amylase.

Examples of amylase enzymes that can be employed in the solid detergent composition of the invention include those sold under the trade name Rapidase by Gist-Brocades™ (Netherlands); those sold under the trade names Termanyl™, Fungamyl™ or Duramyl™ by Novo; those sold under the trade names Purastar STL or Purastar OXAM by Genencor; those sold under the trade names Thermozyme™ L340 or Deterzyme™ PAG 510/220 by Deerland Corporation; and the like. Preferred commercially available amylase enzymes include the stability enhanced variant amylase sold under the trade name Duramyl™ by Novo. A mixture of amylases can also be used.

Amylases suitable for the solid detergent compositions of the present invention, preferably for warewashing, include: I-amylases described in WO 95/26397, PCT/DK96/00056, and GB 1,296,839 to Novo; and stability enhanced amylases described in J. Biol. Chem., 260(11):6518 6521 (1985); WO 9510603 A, WO 9509909 A and WO 9402597 to Novo; references disclosed in WO 9402597; and WO 9418314 to Genencor International. A variant I-amylase employed in the present solid detergent compositions containing stabilized enzymes is preferably at least 80% homologous, preferably having at least 80% sequence identity, with the amino acid sequences of the proteins of these references.

Preferred amylases for use in the solid detergent compositions of the present invention have enhanced stability compared to certain amylases, such as Termamyl™. Enhanced stability refers to a significant or measurable improvement in one or more of: oxidative stability, e.g., to hydrogen peroxide/tetraacetylethylenediamine in buffered solution at pH 9 10;

thermal stability, e.g., at common wash temperatures such as about 60° C.; and/or alkaline stability, e.g., at a pH from about 8 to about 11; each compared to a suitable control amylase, such as Termamyl™. Stability can be measured by methods known to those of skill in the art. Preferred enhanced stability amylases for use in the solid detergent compositions of the present invention have a specific activity at least 25% higher than the specific activity of Termamyl™ at a temperature in a range of 25° C. to 55° C. and at a pH in a range of about 8 to about 10. Amylase activity for such comparisons can be measured by assays known to those of skill in the art and/or commercially available, such as the Phadebas™ I-amylase assay.

In preferred embodiments of this invention, the amount of commercial amylase present in the composition of the invention ranges from about 1 to about 30 wt-%; preferably about 2 to about 15 wt-%; preferably about 3 to about 10 wt-%; preferably about 4 to about 8 wt-%; preferably about 4, about 5, about 6, about 7, or about 8 wt-%, of the commercial enzyme product. Typical commercially available detersive enzymes include about 0.25 5% of active amylase.

Whereas establishing the percentage by weight of amylase required is of practical convenience for manufacturing embodiments of the present teaching, variance in commercial amylase concentrates and in-situ environmental additive and negative effects upon amylase activity may require a more discerning analytical technique for amylase assay to quantify enzyme activity and establish correlations to soil residue removal performance and to enzyme stability within the preferred embodiment and to use-dilution solutions. The activity of the amylases for use in the present invention can be expressed in units known to those of skill or through amylase assays known to those of skill in the art and/or commercially available, such as the Phadebas™ I-amylase assay.

Naturally, mixtures of different amylase enzymes can be incorporated into this invention. While various specific enzymes have been described above, it is to be understood that any amylase which can confer the desired amylase activity to the composition can be used and this embodiment of this invention is not limited in any way by specific choice of amylase enzyme.

Cellulases

A cellulase suitable for the solid detergent composition of the present invention can be derived from a plant, an animal, or a microorganism. Preferably the cellulase is derived from a microorganism, such as a fungus or a bacterium. Preferred cellulases include those derived from a fungus, such as *Humicola insolens, Humicola* strain DSM1800, or a cellulase 212-producing fungus belonging to the genus *Aeromonas* and those extracted from the hepatopancreas of a marine mollusk, Dolabella Auricula Solander. The cellulase can be purified or a component of an extract, and either wild type or variant (either chemical or recombinant).

Examples of cellulase enzymes that can be employed in the solid detergent composition of the invention include those sold under the trade names Carezyme™ or Celluzym™ by Novo; under the tradename Cellulase by Genencor; under the tradename Deerland Cellulase 4000 or Deerland Cellulase TR by Deerland Corporation; and the like. A mixture of cellulases can also be used. Suitable cellulases are described in patent documents including: U.S. Pat. No. 4,435,307, GB-A-2.075.028, GB-A-2.095.275, DE-OS-2.247.832, WO 9117243, and WO 9414951 A (stabilized cellulases) to Novo.

In preferred embodiments of this invention, the amount of commercial cellulase present in the composition of the invention ranges from about 1 to about 30 wt-%; preferably about 2 to about 15 wt-%; preferably about 3 to about 10 wt-%; preferably about 4 to about 8 wt-%; preferably about 4, about 5, about 6, about 7, or about 8 wt-%, of the commercial enzyme product. Typical commercially available detersive enzymes include about 5 10 percent of active enzyme.

Whereas establishing the percentage by weight of cellulase required is of practical convenience for manufacturing embodiments of the present teaching, variance in commercial cellulase concentrates and in-situ environmental additive and negative effects upon cellulase activity may require a more discerning analytical technique for cellulase assay to quantify enzyme activity and establish correlations to soil residue removal performance and to enzyme stability within the preferred embodiment and to use-dilution solutions. The activity of the cellulases for use in the present invention can be expressed in units known to those of skill or through cellulase assays known to those of skill in the art and/or commercially available.

Naturally, mixtures of different cellulase enzymes can be incorporated into this invention. While various specific enzymes have been described above, it is to be understood that any cellulase that can confer the desired cellulase activity to the composition can be used and this embodiment of this invention is not limited in any way by specific choice of cellulase enzyme.

Lipases

A lipase suitable for the solid detergent composition of the present invention can be derived from a plant, an animal, or a microorganism. Preferably the lipase is derived from a microorganism, such as a fungus or a bacterium. Preferred lipases include those derived from a *Pseudomonas*, such as *Pseudomonas stutzeri* ATCC 19.154, or from a *Humicola*, such as *Humicola lanuginosa* (typically produced recombinantly in *Aspergillus oryzae*). The lipase can be purified or a component of an extract, and either wild type or variant (either chemical or recombinant).

Examples of lipase enzymes that can be employed in the solid detergent composition of the invention include those sold under the trade names Lipase P "Amano" or "Amano-P" by Amano Pharmaceutical Co. Ltd., Nagoya, Japan or under the trade name Lipolase™ by Novo, and the like. Other commercially available lipases that can be employed in the present compositions include Amano-CES, lipases derived from *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., and lipases derived from *Pseudomonas gladioli* or from *Humicola lanuginosa*. A preferred lipase is sold under the trade name Lipolase™ by Novo.

Suitable lipases are described in patent documents including: WO 9414951 A (stabilized lipases) to Novo, WO 9205249, RD 94359044, GB 1,372,034, Japanese Patent Application 53,20487, laid open Feb. 24, 1978 to Amano Pharmaceutical Co. Ltd., and EP 341,947.

In preferred embodiments of this invention, the amount of commercial lipase present in the composition of the invention ranges from about 1 to about 30 wt-%; preferably about 2 to about 15 wt-%; preferably about 3 to about 10 wt-%; preferably about 4 to about 8 wt-%; preferably about 4, about 5, about 6, about 7, or about 8 wt-%, of the commercial enzyme product. Typical commercially available detersive enzymes include about 5-10 percent of active enzyme.

Whereas establishing the percentage by weight of lipase required is of practical convenience for manufacturing embodiments of the present teaching, variance in commercial lipase concentrates and in-situ environmental additive and negative effects upon lipase activity may require a more discerning analytical technique for lipase assay to quantify enzyme activity and establish correlations to soil residue removal performance and to enzyme stability within the preferred embodiment and to use-dilution solutions. The activity of the lipases for use in the present invention can be expressed in units known to those of skill or through lipase assays known to those of skill in the art and/or commercially available.

Naturally, mixtures of different lipase enzymes can be incorporated into this invention. While various specific enzymes have been described above, it is to be understood that any lipase that can confer the desired lipase activity to the composition can be used and this embodiment of this invention is not limited in any way by specific choice of lipase enzyme.

Additional Enzymes

Additional enzymes suitable for use in the present solid detergent compositions include a cutinase, a peroxidase, a gluconase, and the like. Suitable cutinase enzymes are described in WO 8809367 A to Genencor. Known peroxidases include horseradish peroxidase, ligninase, and haloperoxidases such as chloro- or bromo-peroxidase. Peroxidases suitable for solid detergent compositions are disclosed in WO 89099813 A and WO 8909813 A to Novo. Peroxidase enzymes can be used in combination with oxygen sources, e.g., percarbonate, percarbonate, hydrogen peroxide, and the like. Additional enzymes suitable for incorporation into the present solid detergent composition are disclosed in WO 9307263 A and WO 9307260 A to Genencor International, WO 8908694 A to Novo, and U.S. Pat. No. 3,553,139 to McCarty et al., U.S. Pat. No. 4,101,457 to Place et al., U.S. Pat. No. 4,507,219 to Hughes and U.S. Pat. No. 4,261,868 to Hora et al.

An additional enzyme, such as a cutinase or peroxidase, suitable for the solid detergent composition of the present invention can be derived from a plant, an animal, or a microorganism. Preferably the enzyme is derived from a microorganism. The enzyme can be purified or a component of an extract, and either wild type or variant (either chemical or recombinant). In preferred embodiments of this invention, the amount of commercial additional enzyme, such as a cutinase or peroxidase, present in the composition of the invention ranges from about 1 to about 30 wt-%, preferably about 2 to about 15 wt-%, preferably about 3 to about 10 wt-%, preferably about 4 to about 8 wt-%, of the commercial enzyme product. Typical commercially available detersive enzymes include about 5 10 percent of active enzyme.

Whereas establishing the percentage by weight of additional enzyme, such as a cutinase or peroxidase, required is of practical convenience for manufacturing embodiments of the present teaching, variance in commercial additional enzyme concentrates and in-situ environmental additive and negative effects upon their activity may require a more discerning analytical technique for the enzyme assay to quantify enzyme activity and establish correlations to soil residue removal performance and to enzyme stability within the preferred embodiment and to use-dilution solutions. The activity of the additional enzyme, such as a cutinase or peroxidase, for use in the present invention can be expressed in units known to those of skill or through assays known to those of skill in the art and/or commercially available.

Naturally, mixtures of different additional enzymes can be incorporated into this invention. While various specific enzymes have been described above, it is to be understood that any additional enzyme that can confer the desired enzyme activity to the composition can be used and this embodiment of this invention is not limited in any way by specific choice of enzyme.

Enzyme Stabilizing System

The enzyme stabilizing system of the present invention includes a mixture of carbonate and bicarbonate. The enzyme stabilizing system can also include other ingredients to stabilize certain enzymes or to enhance or maintain the effect of the mixture of carbonate and bicarbonate.

Stabilizing systems of certain cleaning compositions, for example medical or dental instrument or device solid detergent compositions, may further include from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during warewashing, can be relatively large; accordingly, enzyme stability to chlorine in-use can be problematic. Since percarbonate or percarbonate, which have the ability to react with chlorine bleach, may be present in certain of the instant compositions in amounts accounted for separately from the stabilizing system, the use of additional stabilizers against chlorine, may, most generally, not be essential, though improved results may be obtainable from their use.

Suitable chlorine scavenger anions are widely known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Likewise, special enzyme inhibition systems can be incorporated such that different enzymes have maximum compatibility. Other conventional scavengers such as bisulfate, nitrate, chloride, sources of hydrogen peroxide such as sodium percarbonate tetrahydrate, sodium percarbonate monohydrate and sodium percarbonate, as well as phosphate, condensed phosphate, acetate, benzoate, citrate, formate, lactate, malate, tartrate, salicylate, etc., and mixtures thereof can be used if desired.

In general, since the chlorine scavenger function can be performed by ingredients separately listed under better recognized functions, there is no requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any enzyme scavenger or stabilizer that is unacceptably incompatible, as formulated, with other reactive ingredients. In relation to the use of ammonium salts, such salts can be simply admixed with the solid detergent composition but are prone to adsorb water and/or liberate ammonia during storage. Accordingly, such materials, if present, are desirably protected in a particle such as that described in U.S. Pat. No. 4,652,392, Baginski et al.

Sanitizers

Sanitizing agents also known as antimicrobial agents are chemical compositions that can be used in a solid block functional material to prevent microbial contamination and deterioration of commercial products material systems, surfaces, etc. Generally, these materials fall in specific classes including phenolics, halogen compounds, quaternary ammonium compounds, metal derivatives, amines, alkanol amines, nitro derivatives, analides, organosulfur and sulfur-nitrogen compounds and miscellaneous compounds. The given antimicrobial agent depending on chemical composition and concentration may simply limit further proliferation of numbers of the microbe or may destroy all or a substantial proportion of the microbial population. The terms "microbes" and "microorganisms" typically refer primarily to bacteria and fungus microorganisms. In use, the antimicrobial agents are formed into a solid functional material that when diluted and dispensed using an aqueous stream forms an aqueous disinfectant or sanitizer composition that can be contacted with a variety of surfaces resulting in prevention of growth or the killing of a substantial proportion of the microbial population. A five fold reduction of the microbial population results in a sanitizer composition. Common antimicrobial agents include phenolic antimicrobials such as pentachlorophenol, orthophenylphenol. Halogen containing antibacterial agents include sodium trichloroisocyanurate, sodium dichloroisocyanurate (anhydrous or dihydrate), iodine-poly(vinylpyrrolidinonen) complexes, bromine compounds such as 2-bromo-2-nitropropane-1,3-diol quaternary antimicrobial agents such as benzalconium chloride, cetylpyridiniumchloride, amine and nitro containing antimicrobial compositions such as hexahydro-1,3,5-tris(2-hydroxyethyl)-s-triazine, dithiocarbamates such as sodium dimethyldithiocarbamate, and a variety of other materials known in the art for their microbial properties. Sanitizers may be encapsulated to improve stability and/or to reduce reactivity with other materials in the solid detergent composition.

Rinse Aid Functional Materials

Functional materials of the invention can comprise a formulated rinse aid composition containing a wetting or sheeting agent combined with other optional ingredients in a solid block made using the hydrate complex of the invention. The rinse aid components of the cast solid rinse aid of the invention is a water soluble or dispersible low foaming organic material capable of reducing the surface tension of the rinse water to promote sheeting action and to prevent spotting or streaking caused by beaded water after rinsing is complete in warewashing processes. Such sheeting agents are typically organic surfactant like materials having a characteristic cloud point. The cloud point of the surfactant rinse or sheeting agent is defined as the temperature at which a 1 wt. % aqueous solution of the surfactant turns cloudy when warmed. Since there are two general types of rinse cycles in commercial warewashing machines, a first type generally considered a sanitizing rinse cycle uses rinse water at a temperature of about 180° F., about 80° C. or higher. A second type of non-sanitizing machines uses a lower temperature non-sanitizing rinse, typically at a temperature of about 125° F., about 50° C. or higher. Surfactants useful in these applications are aqueous rinses having a cloud point greater than the available hot service water. Accordingly, the lowest useful cloud point measured for the surfactants of the invention is approximately 40° C. The cloud point can also be 60° C. or higher, 70° C. or higher, 80° C. or higher, etc., depending on the use locus hot water temperature and the temperature and type of rinse cycle. Preferred sheeting Agents, typically comprise a polyether compound prepared from ethylene oxide, propylene oxide, or a mixture in a homopolymer or block or heteric copolymer structure. Such polyether compounds are known as polyalkylene oxide polymers, polyoxyalkylene polymers or polyalkylene glycol polymers. Such sheeting agents require a region of relative hydrophobicity and a region of relative hydrophilicity to provide surfactant properties to the molecule. Such sheeting agents have a molecular weight in the range of about 500 to 15,000. Certain types of (PO)(EO) polymeric rinse aids have been found to be useful containing at least one block of poly(PO) and at least one block of poly(EO) in the polymer molecule. Additional blocks of poly (EO), poly PO or random polymerized regions can be formed in the molecule. Particularly useful polyoxypropylene polyoxyethylene block copolymers are those comprising a center block of polyoxypropylene units and blocks of polyoxyethylene units to each side of the center block. Such polymers have the formula shown below: $(EO)_n$—$(PO)_m$-$(EO)_n$ wherein n is an integer of 20 to 60, each end is independently an integer of 10 to 130. Another useful block copolymer is block copolymers having a center block of polyoxyethylene units and blocks of polyoxypropylene to each side of the center block. Such copolymers have the formula: $(PO)_n$-$(EO)_m$—$(PO)_n$ wherein m is an integer of 15 to 175 and each end are independently integers of about 10 to 30. The solid functional materials of the invention can often use a hydrotrope to aid in maintaining the solubility of sheeting or wetting agents. Hydrotropes can be used to modify the aqueous solution creating increased solubility for the organic material. Preferred hydrotropes are low molecular weight aromatic sulfonate materials such as xylene sulfonates and dialkyldiphenyl oxide sulfonate materials.

Bleaching Agents

Bleaching agents for use in the solid detergent compositions for lightening or whitening a substrate, include bleaching compounds capable of liberating an active halogen species, such as $Cl_2$, $Br_2$, —$OCl^-$ and/or —$OBr^-$, under conditions typically encountered during the cleansing process. Suitable bleaching agents for use in the present solid detergent compositions include, for example, chlorine-containing compounds such as a chlorine, a hypochlorite, chloramine. Preferred halogen-releasing compounds include the alkali metal dichloroisocyanurates, chlorinated trisodium phosphate, the alkali metal hypochlorites, monochlorarrine and dichloramine, and the like. Encapsulated bleaching sources may also be used to enhance the stability of the bleaching source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A solid detergent composition may include a minor but effective amount of a bleaching agent, preferably about 0.1 10 wt. %, preferably about 1 6 wt. %.

Defoaming Agents

A minor but effective amount of a defoaming agent for reducing the stability of foam may also be included in the present solid detergent compositions. Preferably, the solid detergent composition includes about 0.0001 5 wt. % of a defoaming agent, preferably about 0.01 3 wt. %.

Examples of defoaming agents suitable for use in the present compositions include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-Redeposition Agents

A solid detergent composition may also include an anti-redeposition agent capable of facilitating sustained suspension of soils in a use solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. A solid detergent composition may include about 0.5 10 wt. %, preferably about 1 5 wt. %, of an anti-redeposition agent.

Optical Brighteners

Optical brightener is also referred to as fluorescent whitening agents or fluorescent brightening agents provide optical compensation for the yellow cast in fabric substrates. With optical brighteners yellowing is replaced by light emitted from optical brighteners present in the area commensurate in scope with yellow color. The violet to blue light supplied by the optical brighteners combines with other light reflected from the location to provide a substantially complete or enhanced bright white appearance. This additional light is produced by the brightener through fluorescence. Optical brighteners absorb light in the ultraviolet range 275 through 400 nm and emit light in the ultraviolet blue spectrum 400 500 nm Fluorescent compounds belonging to the optical brightener family are typically aromatic or aromatic heterocyclic materials often containing condensed ring system. An important feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (cumarins, naphthalamides, triazines, etc.). The choice of optical brighteners for use in detergent compositions will depend upon a number of factors, such as the type of detergent, the nature of other components present in the detergent composition, the temperature of the wash water, the degree of agitation, and the ratio of the material washed to the tub size. The brightener selection is also dependent upon the type of material to be cleaned, e.g., cottons, synthetics, etc. Since most laundry detergent products are used to clean a variety of fabrics, the detergent compositions should contain a mixture of brighteners that are effective for a variety of fabrics. It is of course necessary that the individual components of such a brightener mixture be compatible.

Optical brighteners useful in the present invention are commercially available and will be appreciated by those skilled in the art. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles and other miscellaneous agents. Examples of these types of brighteners are disclosed in "The Production and Application of Fluorescent Brightening Agents", M. Zahradnik, Published by John Wiley & Sons, New York (1982), the disclosure of which is incorporated herein by reference.

Stilbene derivatives which may be useful in the present invention include, but are not necessarily limited to, derivatives of bis(triazinyl)amino-stilbene; bisacylamino derivatives of stilbene; triazole derivatives of stilbene; oxadiazole derivatives of stilbene; oxazole derivatives of stilbene; and styryl derivatives of stilbene.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Other Ingredients

A wide variety of other ingredients useful in detergent compositions can be included in the compositions hereof, including other active ingredients, builders, carriers, processing aids, dyes or pigments, perfumes, solvents for liquid formulations, hydrotropes (as described below), etc. Low molecular weight primary or secondary alcohols exemplified by methanol, ethanol, propanol, and isopropanol are suitable. Monohydric alcohols are preferred for solubilizing surfactant, but polyols such as those containing from about 2 to about 6 carbon atoms and from about 2 to about 6 hydroxy groups (e.g., propylene glycol, ethylene glycol, glycerine, and 1,2-propanediol) can also be used.

Manufacturing the Solid Detergent Composition

The invention provides a method for manufacturing a solid detergent composition. According to the invention, cleaning agents, branched fatty acid disintegrator, and other additives, as desired, are mixed together in a mixing system. Preferably, the mixing system is sufficient to provide dispersion of the binding agent throughout the detergent composition. Heat may be applied from an external source to facilitate processing of the mixture.

A mixing system provides for continuous mixing of the ingredients at high shear to form a substantially homogeneous liquid or semi-solid mixture in which the ingredients are distributed throughout its mass. Preferably, the mixing system includes means for mixing the ingredients to provide shear effective for maintaining the mixture at a flowable consistency, with a viscosity during processing of greater than about 1,000 cps, preferably 1,000 1,000,000 cps, and more preferably about 50,000 200,000 cps. The mixing system is preferably a continuous flow mixer or more preferably, a single or twin screw extruder apparatus, with a twin-screw extruder being highly preferred.

The mixture is typically processed at a temperature to maintain the physical and chemical stability of the ingredients, preferably at ambient temperatures of about 20-80° C., more preferably about 25-55° C. Although limited external heat may be applied to the mixture, the temperature achieved by the mixture may become elevated during processing due to friction, variances in ambient conditions, and/or by an exothermic reaction between ingredients. Optionally, the temperature of the mixture may be increased, for example, at the inlets or outlets of the mixing system.

An ingredient may be in the form of a liquid or a solid such as a dry particulate, and may be added to the mixture separately or as part of a premix with another ingredient, as for example, the cleaning agent, the aqueous medium, and additional ingredients such as a second cleaning agent, a detergent adjuvant or other additive, a secondary hardening agent, and the like. One or more premixes may be added to the mixture.

The ingredients are mixed to form a substantially homogeneous consistency wherein the ingredients are distributed substantially evenly throughout the mass. The mixture is then discharged from the mixing system through a die or other shaping means. The profiled extrudate then can be divided into useful sizes with a controlled mass. Preferably, the extruded solid is packaged in film. The temperature of the mixture when discharged from the mixing system is preferably sufficiently low to enable the mixture to be cast or extruded directly into a packaging system without first cooling the mixture. The time between extrusion discharge and packaging may be adjusted to allow the hardening of the detergent block for better handling during further processing and packaging. Preferably, the mixture at the point of discharge is about 20 90° C., preferably about 25-55° C. The composition is then allowed to harden to a solid form that may range from a low density, sponge-like, malleable, caulky consistency to a high density, fused solid, concrete-like block.

Optionally, heating and cooling devices may be mounted adjacent to mixing apparatus to apply or remove heat in order to obtain a desired temperature profile in the mixer. For example, an external source of heat may be applied to one or more barrel sections of the mixer, such as the ingredient inlet section, the final outlet section, and the like, to increase fluidity of the mixture during processing. Preferably, the temperature of the mixture during processing, including at the discharge port, is maintained preferably at about 20-90° C.

When processing of the ingredients is completed, the mixture may be discharged from the mixer through a discharge die. The composition eventually hardens. The solidification process may last from a few minutes to about six hours, depending, for example, on the size of the cast or extruded composition, the ingredients of the composition, the temperature of the composition, and other like factors. Preferably, the cast or extruded composition "sets up" or begins to hardens to a solid form within about 1 minute to about 3 hours, preferably about 1 minute to about 2 hours, preferably about 1 minute to about 20 minutes.

The packaging receptacle or container may be rigid or flexible, and composed of any material suitable for containing the compositions produced according to the invention, as for example glass, metal, plastic film or sheet, cardboard, cardboard composites, paper, and the like.

Advantageously, since the composition is processed at or near ambient temperatures, the temperature of the processed mixture is low enough so that the mixture may be cast or extruded directly into the container or other packaging system without structurally damaging the material. As a result, a wider variety of materials may be used to manufacture the container than those used for compositions that processed and dispensed under molten conditions. Preferred packaging used to contain the compositions is manufactured from a flexible, easy opening film material.

The packaging material can be provided as a water soluble packaging material such as a water soluble packaging film. Exemplary water soluble packaging films are disclosed in U.S. Pat. Nos. 6,503,879; 6,228,825; 6,303,553; 6,475,977; and 6,632,785, the disclosures of which are incorporated herein by reference. An exemplary water soluble polymer that can provide a packaging material that can be used to package the concentrate includes polyvinyl alcohol. The packaged concentrate can be provided as unit dose packages or multiple dose packages. In the case of unit dose packages, it is expected that a single packaged unit will be placed in a dishwashing machine, such as the detergent compartment of the dishwashing machine, and will be used up during a single wash cycle. In the case of a multiple dose package, it is expected that the unit will be placed in a hopper and a stream of water will degrade a surface of the concentrate to provide a liquid concentrate that will be introduced into the dishwashing machine.

Suitable water soluble polymers which may be used in the invention are described in Davidson and Sittig, Water Soluble Resins, Van Nostrand Reinhold Company, New York (1968), herein incorporated by reference. The water soluble polymer should have proper characteristics such as strength and pliability in order to permit machine handling. Preferred water soluble polymers include polyvinyl alcohol, cellulose ethers, polyethylene oxide, starch, polyvinylpyrrolidone, polyacrylamide, polyvinyl methyl ether-maleic anhydride, polymaleic anhydride, styrene maleic anhydride, hydroxyethylcellulose, methylcellulose, polyethylene glycols, carboxymethylcellulose, polyacrylic acid salts, alginates, acrylamide copolymers, guar gum, casein, ethylene-maleic anhydride resin series, polyethyleneimine, ethyl hydroxyethylcellulose, ethyl methylcellulose, hydroxyethyl methylcellulose. Lower molecular weight water soluble, polyvinyl alcohol film-forming polymers are generally, preferred. Polyvinyl alcohols that can be used include those having a weight average molecular weight of between about 1,000 and about 300,000, and between about 2,000 and about 150,000, and between about 3,000 and about 100,000.

Dispensing the Solid Detergent Composition

The solid detergent composition made according to the present invention can be dispensed from a spray-type dispenser such as that disclosed in U.S. Pat. Nos. 4,826,661, 4,690,305, 4,687,121, 4,426,362 and in U.S. Pat. Nos. Re 32,763 and 32,818, the disclosures of which are incorporated by reference herein. Briefly, a spray-type dispenser functions by impinging a water spray upon an exposed surface of the solid composition to dissolve a portion of the composition, and then immediately directing the concentrate solution comprising the composition out of the dispenser to a storage reservoir or directly to a point of use. When used, the product is removed from the package (e.g.) film and is inserted into the dispenser. The spray of water can be made by a nozzle in a shape that conforms to the solid detergent shape. The dispenser enclosure can also closely fit the detergent shape in a dispensing system that prevents the introduction and dispensing of an incorrect detergent.

When the solid detergent composition is provided as a unit dose, the solid detergent composition can be introduced into the cleaning environment to form the use solution. In the case of a warewashing machine, the unit dose can be dropped into the warewashing machine. The unit dose can be hand dropped into the warewashing machine or it can be dispensed mechanically into the warewashing machine. In addition, the unit dose can be used to form a concentrate that is then introduced into the warewashing machine.

Use

The solid detergent composition can be referred to as the solid composition as the cleaning composition, or as the composition. The solid detergent composition can be available for cleaning in environments including automatic dishwashing or warewashing machines, use as rinse aids therein, laundry, a pot and pan cleaner, cleaner for rotary fryers and deep fat fryers, floors, and for manual cleaning glass, dishes, etc. in a sink Furthermore, the solid detergent composition can refer to the composition provided in the form of a concentrate or provided in the form of a use composition. In general, a concentrate is the composition that is intended to be diluted with water to provide the use composition that contacts the surface to provide the desired effect, such as, cleaning. Furthermore, the detergent composition can be used in environments including, for example, bottle washing and car washing.

The solid detergent composition that is dissolved for contact with the articles to be cleaned can be referred to as the use composition. The use composition can be provided at a solids concentration that provides a desired level of detersive properties. The solids concentration refers to the concentration of the non-water components in the use composition. The solid detergent composition prior to dilution to provide the use composition can be referred to as the solid composition, the solid detergent composition, or as the concentrate.

The solid detergent composition can be used by dissolving the concentrate with water or other aqueous media at the situs or location of use to provide the use composition. In many cases when using the solid detergent composition in an automatic dishwashing or warewashing machine, it is expected that that situs or location of use will be inside the automatic dishwashing or warewashing machine. When the solid detergent composition is used in a residential or home-style dishwashing machine, the composition can be placed in the detergent compartment of the dishwashing machine. Often the detergent compartment is located in the door of the dishwashing machine. The solid detergent composition can be provided in the form that allows for introduction of a single dose of the solid detergent composition into the compartment. In general, a single dose refers to the amount of the solid detergent composition that is desired for a single warewashing cycle. In many commercial dishwashing or warewashing machines, and even for certain residential or home-style dishwashing machines, it is expected that a large quantity of solid detergent composition can be provided in a compartment that allows for the release of a single dose amount of the composition for each warewashing or dishwashing cycle. Such a compartment may be provided as part of the warewashing or dishwashing machine or it may be provided as a separate structure connected to the warewashing or dishwashing machine by a hose for delivery of the composition to the warewashing or dishwashing machine. For example, a block of the solid detergent composition can be provided in a hopper, and water can be sprayed against the surface of the block to provide a liquid concentrate that can be introduced into the dishwashing machine. The hopper can be a part of the dishwashing machine or it can be provided separate from the dishwashing machine.

The water that is used to dilute the concentrate to form the use composition can be referred to as water of dilution, and can vary from one location to another. It is expected that water available at one location may have a relatively low level of total dissolved solids while water at another location may have a relatively high level of total dissolved solids. In general, hard water is considered to be water having a total dissolved solids content in excessive of 200 ppm. The warewashing detergent composition according to the invention can be provided so that detergency properties are provided in the presence of water of dilution that is soft water or water of dilution that is hard water.

The use composition can have a solids content that is sufficient to provide the desired level of cleaning while avoiding wasting the solid detergent composition by using too much. In most embodiments, the solids present in the use solution are stable in solution, meaning that they remain dispersed in the use solution without precipitation and rapid degradation during use. In general, the use composition can have a solids content of at least about 0.05 wt. % to provide a desired level of cleaning. In addition, the use composition can have a solids content of less than about 1.0 wt. % to avoid using too much of the composition. In addition, the use composition can have a solids content of about 0.05 wt. % to about 0.75 wt. %. In certain embodiments, the solid detergent composition readily dissolves in aqueous media to form a use solution having a solids content of about 3-5 wt. %, in further embodiments, about 4 wt. %. The use composition can be prepared from the concentrate by diluting with water at a dilution ratio that provides convenient use of the concentrate and provides the formation of a use composition having desired detersive properties. The concentrate can be diluted at a ratio of water to concentrate of at least about 20:1, and can be at about 20:1 to about 2000:1, to provide a use composition having desired detersive properties.

The above specification provides a basis for understanding the broad meets and bounds of the invention. The following examples and test data provide an understanding of certain specific embodiments of the invention. The examples are not meant to limit the scope of the invention that has been set forth in the foregoing description. Variations within the concepts of the invention are apparent to those skilled in the art.

The following examples are provided for the purpose of illustration, not limitation.

EXAMPLES

Materials and Suppliers

Colatrope or Colatrope—INC: sodium isononanoate: Colonial Chemical, Inc. Chattanooga, Tenn., under the tradename COLA®TROPE—INC. Also designated as "INN" in tables below.

Mironal FBS: dicarboxylic acid coconut deriv. Sodium salt, 38%.

Dehypon LS-36: low-foaming fatty alcohol C12-C14 EO/PO derivative surfactant, Fitz Chem. Corporation.

D-500: ethoxy-propoxy copolymer, tradename SURFONIC D-500, Huntsman International LLC.

Versenol 120 Chelating Agent: hydroxyethylidenetriacetic acid 40% (HEDTA), Dow Chemical Company.

Genapol w-030: branched nonionic surfactant, Clariant Functional Chemicals, Muttenz, Switzerland.

Genapol UD-030: branched nonionic surfactant, Clariant Functional Chemicals, Muttenz, Switzerland.

Dissolving Rate Test Procedure

The test procedures used in the current invention include three developed test procedures. The first test procedure is a dissolving rate test procedure. This test procedure measures the dissolution rate of the solid when it is added to water at various temperatures. The test procedure is as follows:

1. Bring 3500 mls of soft water to designate temperature in a 4000 ml beaker on a hotplate.
2. Add screen support to beaker (screen support positions sample 7.5 cm from bottom of beaker).
3. Record weight solid sample to be tested.
4. When water reaches designated temperature, add sample and start stopwatch.
5. Record time when no sample remains on the screen.

All dissolving rate test results presented below were performed according to the above procedure at 155° F. unless otherwise noted. The dissolving rate test procedure may also be performed at other designated temperatures at or above room temperature and below boiling point of the aqueous solution. Example designate temperatures include, for example, but are not limited to 130° F. and 190° F.

Standard room temperature, pressure, etc. conditions are otherwise applicable.

Solid detergent compositions according to the invention including sodium isononanoate were compared in parallel Dissolution Tests to similar detergent composition formulations lacking branched fatty acid disintegrator.

Examples A-B and Comparative Examples C-E

Examples A and B are solid detergent formulas including sodium isononanoate (Colonial Chemical, Co.). Compare to similar formulas presented in Examples C, D, and E which do not include a branched fatty acid disintegrator, such as sodium isononanoate. The dissolving rate test results demonstrate that Examples A and B including branched fatty acid disintegrators dissolved at improved rates. Example A dissolved 3 times faster than Comparative Example D, 4 times faster than Example C, and more than 5 times faster than Example E.

TABLE 1

| | INN Example A | INN Example B | TSP + ash Example C | TSP + water Example D | ash + water Example E |
|---|---|---|---|---|---|
| Water | 6.45 | 4.05 | 5.85 | 12.85 | 17.45 |
| NaOH 50% | 19.6 | 22 | 28.6 | 28.6 | 19.6 |
| Colatrope—INC 45% | 20 | 20 | | | |
| phosphoric acid 75% | 12 | 12 | 15.6 | 15.6 | 12 |
| Mironal FBS—40% active | 5 | 5 | 5 | 5 | 5 |
| Dehypon LS-36 | | | | | |
| D-500 | 1 | 1 | 1 | 1 | 1 |
| Versonal—HEDTA | 9.95 | 9.95 | 9.95 | 9.95 | 9.95 |
| Dense Ash | 26 | 26 | 34 | 27 | 35 |
| Total | 100.00 | 100.00 | 100.00 | 100.00 | 100.00 |
| % water | 39.12 | 37.92 | 32.92 | 39.92 | 39.12 |
| Sample wt (g) | 250 | 568 | 270 | 268 | 274 |
| dissolve time (min) | 2.5 | 6.5 | 11.5 | 8.75 | 18.5 |
| Temperature | 190° F. | 190° F. | 190° F. | 190° F. | 190° F. |
| Dissolve rate g/min. | 100 | 87 | 23 | 31 | 15 |

Dissolution rate for the Example A was at 100 g/min A similar formula relying on a combination of ash and water instead of a branched fatty acid disintegrator has a slower dissolution rate of 15 g/min Thus, the presence of the branched fatty acid disintegrator, in this particular example, sodium isononanonate improves the dissolution rate by approximately three times, more preferably five times of the rate without the branched fatty acid disintegrator.

Examples F-M Solid Detergent Compositions and Comparative Examples N-Q

Additional data shown in Tables 2-5 demonstrates the disintegration activity of various branched fatty acid disintegrators compared with linear (non-branched) fatty acids. Examples F-M are solid detergent compositions including branched fatty acid disintegrators, while comparative examples N-Q have a similar formulation with the exception of substitution of a linear fatty acid. As is noticed in the various examples F-M, isononanoic acid, isooctanoic, neodecanoic, neopentanoic acid were utilized along with sodium isononanonate in various amounts. The dissolution rate was measured according to the Dissolution rate test described above. The solid detergent compositions of examples F-M demonstrate improved dissolution of at least 15 g/minute of solid detergent compositions solidified with dense ash. Examples F-L which utilize a branched fatty acid disintegrator whose main chain is octanoic acid or longer (e.g., $C_9$ to $C_{12}$ branched fatty acid disintegrators) demonstrate dissolution of greater than 30 g/minute under the test conditions.

TABLE 2

| | % Water | Example F INN | Example G isononanoic | Example H isononanoic | Example I isooctanoic |
|---|---|---|---|---|---|
| Water | 100 | 6.45 | 15.79 | 5.79 | 15.64 |
| NaOH 50% (phosphoric) | 50 | 19.6 | 19.6 | 19.6 | 19.6 |
| NaOH 50% (fatty acid) | 50 | | 2.277911392 | 2.277911392 | 2.499375 |
| Isononanoic Acid | 0.1 | | 9 | 9 | 0 |
| Isooctanoic Acid | | | 0 | 0 | 9 |
| Neodecanoic Acid | | | 0 | 0 | 0 |
| Neopentanoic Acid | | | 0 | 0 | 0 |
| Sodium isononanoate—45% | 55 | 20 | | | |
| phosphoric acid 75% | 25 | 12 | 12 | 12 | 12 |
| Mironal FBS—40% active | 60 | 5 | 5 | 5 | 5 |
| Dehypon LS-36 | 0 | 0 | 0 | 0 | 0 |
| D-500 | 0 | 1 | 1 | 1 | 1 |
| Versonal—HEDTA | 59 | 9.95 | 9.95 | 9.95 | 9.95 |
| Dense Ash | 0 | 26 | 25.38 | 35.38 | 25.31 |
| Total | | 100.00 | 100.00 | 100.00 | 100.00 |
| Water Neut of Phosphoric acid | | 4.41 | 4.41 | 4.41 | 4.41 |
| Water Neut of fatty acid | | | 0.51 | 0.51 | 0.56 |
| % water | | 43.53 | 43.53 | 33.53 | 43.53 |
| Sample wt (g) | | 250 | 253.36 | 258.44 | 251.56 |
| Volume (mls) | | 4000 | 4000 | 4000 | 4000 |
| Temperature ° F. | | 155° F. | 155° F. | 155° F. | 155° F. |
| Dissolution Rate (g/min.) | | 30.4 | 38.70 | 52.40 | 34.50 |

TABLE 3

| | % Water | Example J isooctanoic | Example K neodecanoic | Example L neodecanoic | Example M neopentanoic |
|---|---|---|---|---|---|
| Water | 100 | 5.64 | 15.93 | 5.93 | 14.89 |
| NaOH 50% (phosphoric) | 50 | 19.6 | 19.6 | 19.6 | 19.6 |
| NaOH 50% (fatty acid) | 50 | 2.499375 | 2.0925 | 2.0925 | 3.528529412 |
| Isononanoic Acid | 0.1 | 0 | 0 | 0 | 0 |
| Isooctanoic Acid | | 9 | 0 | 0 | 0 |
| Neodecanoic Acid | | 0 | 9 | 9 | 0 |
| Neopentanoic Acid | | 0 | 0 | 0 | 9 |
| Colatrope—45% | 55 | | | | |
| phosphoric acid 75% | 25 | 12 | 12 | 12 | 12 |
| Mironal FBS—40% active | 60 | 5 | 5 | 5 | 5 |
| Dehypon LS-36 | 0 | 0 | 0 | 0 | 0 |
| D-500 | 0 | 1 | 1 | 1 | 1 |
| Versonal—HEDTA | 59 | 9.95 | 9.95 | 9.95 | 9.95 |
| Dense Ash | 0 | 35.31 | 25.43 | 35.43 | 25.03 |
| Total | | 100.00 | 100.00 | 100.00 | 100.00 |
| Water Neut of Phosphoric acid | | 4.41 | 4.41 | 4.41 | 4.41 |
| Water Neut of fatty acid | | 0.56 | 0.47 | 0.47 | 0.79 |
| % water | | 33.53 | 43.53 | 33.53 | 43.53 |
| Sample wt (g) | | 241.47 | 246.37 | 250.21 | 251.06 |
| Volume (mls) | | 4000 | 4000 | 4000 | 4000 |
| Temperature ° F. | | 155° F. | 155° F. | 155° F. | 155° F. |
| Dissolution Rate (g/min.) | | 42.20 | 69.70 | 25.90 | 15.10 |

TABLE 4

| | % Water | Comparative Example P X-030 | Comparative Example Q X3-030—.64% | Comparative Example R UD-030 | Comparative Example S UD-030—1% |
|---|---|---|---|---|---|
| Water | 100 | 6.45 | 5.80 | 6.45 | 5.48 |
| NaOH 50% (phosphoric) | 50 | 19.60 | 19.60 | 19.60 | 19.60 |
| NaOH 50% (fatty acid) | 50 | | | | |
| Isononanoic Acid | 0.1 | | | | |
| Isooctanoic Acid | | | | | |
| Neodecanoic Acid | | | | | |
| Neopentanoic Acid | | | | | |
| Sodium isononanoate—45% | 55 | | | | |
| Genapol w-030 | 100 | 11.00 | 11.00 | | |
| Genapol UD-030 | 100 | | | 11.00 | 11.00 |
| phosphoric acid 75% | 25 | 12.00 | 12.00 | 12.00 | 12.00 |
| Mironal FBS—40% active | 60 | 5.00 | 5.00 | 5.00 | 5.00 |
| Dehypon LS-36 | 0 | 0.00 | | 0.00 | |
| D-500 | 0 | 1.00 | 1.00 | 1.00 | 1.00 |
| Versonal—HEDTA | 59 | 9.95 | 9.95 | 9.95 | 9.95 |
| Dense Ash | 0 | 35.00 | 35.64 | 35.00 | 35.97 |
| Total | | 100.00 | 100.00 | 100.00 | 100.00 |
| Water Neut of Phosphoric acid | | 4.41 | 4.41 | 4.41 | 4.41 |
| Water Neut of fatty acid | | | | | |
| % water | | 43.530 | 42.885 | 43.530 | 42.563 |
| Sample wt (g) | | 241.51 | 50.13 | 248.53 | 48.42 |
| Volume (mls) | | 4000 | 4000 | 4000 | 4000 |
| Temperature ° F. | | 155° F. | 155° F. | 155° F. | 155° F. |
| Dissolution Rate (g/min.) | | 8.9 | 4.9 | 7.7 | 3.2 |

Examples S & U Solid Detergent Compositions and Comparative Examples R & T

The Solid Detergent Compositions S and U are formulated as rinse aids including branched fatty acid disintegrators in combination with organic binding agents. As seen by comparison with similarly formulated comparative examples R and T lacking branched fatty acid disintegrators, improvement in disintegration rate is shown.

TABLE 5

| | Rinse Aid Formulations | | | |
|---|---|---|---|---|
| | Rinse Aid formula 1 | | Rinse Aid formula 2 | |
| | Formula | | | |
| | Comparative Example R (w/o INN) % | Example S (with INN) % | Comparative Example T (w/o INN) % | Example U (with INN) % |
| urea | 16.00 | 15.76 | | |
| polyoxyethylene polyoxypropylene polymer | 73.62 | 72.53 | 8.00 | 7.89 |
| propylene glycol | 3.00 | 2.96 | | |
| polyethylene glycol 8000 | | | 15.29 | 15.02 |
| linear alcohol ethoxylate | 3.00 | 2.96 | | |
| linear alcohol ethoxylate, benzyl capped | | | 55.51 | 54.72 |
| sodium alkyl sulfonate | | | 20.00 | 19.71 |
| water | 3.30 | 3.25 | 0.64 | 0.63 |
| dye | 0.28 | 0.28 | 0.03 | 0.03 |
| chloro methyl isothiazolin mixture glutaraldehyde | 0.74 | 0.73 | 0.54 | 0.53 |
| sodium isononanoate | | 1.50 | | 1.50 |
| hydrochloric acid 31.5% | 0.06 | 0.06 | | |
| Total | 100.0 | 100.0 | 100.0 | 100.0 |
| Sample wt (g) | 7.68 | 4.58 | 5.77 | 6.05 |
| Volume (mls) | 4000 | 4000 | 4000 | 4000 |
| Temperature ° F. | 130° F. | 130° F. | 130° F. | 130° F. |
| disintegration/dissolving Rate (g/minute) | 0.37 | 0.44 | 0.98 | 1.07 |

Example W Solid Metal-Protecting Machine Warewashing Detergent Composition and Comparative Example V

TABLE 6

| | Formula | |
|---|---|---|
| | Comparative Example V (w/o INN) % | Example W (with INN) % |
| water | 35 | 32.8 |
| sodium carbonate | 12 | 12 |
| sodium metasilicate | 25 | 25 |
| sodium tripolyphosphate hexahydrate | 28 | 26.2 |
| sodium isononanoate | | 4 |
| Total | 100 | 100 |
| Sample wt (g) | 13.9 | 10.76 |
| Volume (mls) | 4000 | 4000 |
| Temperature ° F. | 122° F. | 122° F. |
| disintegration/dissolving rate (g/minute) | 0.87 | 1.2 |

Example Y Solid Machine Warewashing Detergent Composition and Comparative Example X

TABLE 7

| | Formula | |
|---|---|---|
| | Comparative Example X (w/o INN) % | Example Y (with INN) % |
| water | 16 | 13.3 |
| sodium hydroxide | 36.8 | 36.8 |
| sodium carbonate | 26 | 26 |
| sodium tripolyphosphate | 14 | 14 |
| sodium sulfate | 5.5 | 3.2 |
| sodium polyacrylate | 1 | 1 |
| ethoxy-propoxy copolymer | 0.7 | 0.7 |
| sodium isononanoate | | 5 |
| Total | 100.0 | 100.0 |
| Sample wt (g) | 15.1 | 13.6 |
| Volume (mls) | 4000 | 4000 |
| Temperature ° F. | 122° F. | 122° F. |
| disintegration/dissolving rate (g/minute) | 1.51 | 1.7 |

Examples AA and AC Solid Manual Pot and Pan Detergent Compositions and Comparative Examples Z and AB

TABLE 8

| | Formula | | | |
|---|---|---|---|---|
| | Comparative Example Z (w/o INN) PP-01 % | AA (with INN) PP-02 % | Comparative Example AB (w/o INN) PP-03 % | AC (with INN) PP-04 % |
| lauric monoethanolamide | 23.4 | 23.4 | 11.8 | 11.8 |
| polyethylene glycol 8000 | 8.5 | 8.5 | 4.3 | 4.3 |
| sodium laureth sulfate 70% | 38.3 | 38.3 | 19.4 | 19.4 |
| sodium linear alkyl benzene sulfonate 90% | | | 49.4 | 47.3 |
| sodium acetate | 29.8 | | 15.1 | 2.2 |
| sodium isononanoate 45% | | 29.8 | | 15.1 |
| total | 100 | 100 | 100 | 100 |
| wt. % dissolved in 10 minutes | 25.5% | 100.0% | 7.3% | 52.7% |

Examples AE and AG Solid Floor Cleaner Detergent Compositions and Comparative Examples AD and AF

TABLE 9

| | Formula | | | |
|---|---|---|---|---|
| | Floor cleaner formula A | | Floor cleaner formula B | |
| | Comparative Example AD (w/o INN) % | Example AE (with INN) % | Comparative Example AF (w/o INN) % | Example AG (with INN) % |
| alcohol alkoxylate C10 | 63 | 63 | 63 | 63 |
| urea | 27 | 27 | 27 | 27 |
| sodium isononanoate 45% | 0 | 2.18 | 0 | 3.38 |
| water | qs | qs | qs | qs |
| Sample wt (g) | 0.3 | 0.3 | 0.3 | 0.3 |
| Volume (mls) | 100 | 100 | 100 | 100 |
| Temperature ° C. | 21.7° C. | 21.7° C. | 21.7° C. | 21.7° C. |
| Time (min) | 11 min. | 5 min. | 11 min. | 3.5 min. |
| disintegration/ dissolving rate (g/minute | 0.03 | 0.06 | 0.03 | 0.09 |

Example AI Solid Presoak Detergent Composition and Comparative Example AK

TABLE 10

| | Formula Presoak formula | |
|---|---|---|
| | Comparative Example AK (w/o INN) % | Example AI (with INN) % |
| Sodium carbonate | 24.0 | 24.0 |
| sodium polyacrylate | 1.0 | 1.0 |
| linear alcohol ethoxylate C12-14, 7 EO | 4.0 | 4.0 |
| Sodium tripoly phosphate | 38.0 | 34.0 |
| Sodium isononanoate | | 4.0 |
| water | 33.0 | 33.0 |
| total | 100.0 | 100.0 |
| disintegration/ dissolving Rate | | |
| Test 1 sample wt (g) | 30.2 | 33.8 |
| Time to disintegrate (minutes) | 8.4 | 2.1 |
| Rate (g/minute) | 3.6 | 16.2 |
| Test 2, sample wt (g) | 12.5 | 15.8 |
| Time to disintegrate (minutes) | 10.8 | 3.0 |
| Rate (g/minute) | 1.2 | 5.3 |

* INN = sodium isononanoate

Example AJ Solid Degreaser Detergent Composition and Comparative Examples AK-AM

TABLE 11

| | Formula | | | |
|---|---|---|---|---|
| | Example AJ with INN | Comparative Example AK w/o INN* | Comparative Example AL w/o INN* | Comparative Example AM w/o INN* |
| Water | 6.45 | 5.85 | 12.85 | 17.45 |
| sodium hydroxide 50% | 19.6 | 28.6 | 28.6 | 19.6 |
| phosphoric acid 75% | 12 | 15.6 | 15.6 | 12 |
| alkyl imidazolimium dicarboxylate sodium salt 40% | 5 | 5 | 5 | 5 |
| ethoxy-propoxy copolymer | 1 | 1 | 1 | 1 |
| hydroxyethylidene-triacetic acid 40% | 9.95 | 9.95 | 9.95 | 9.95 |
| sodium carbonate | 26 | 34 | 27 | 35 |
| sodium isononanoate 45% | 20 | | | |
| Total | 100 | 100 | 100 | 100 |
| % water | 39.12 | 32.92 | 39.92 | 39.12 |
| sample wt (g) | 250 | 270 | 268 | 274 |
| dissolve time (min) | 2.5 | 11.5 | 8.8 | 18.5 |
| Dissolve rate g/min. | 100 | 23 | 31 | 15 |

Examples AN-AQ and Comparative Examples AR-AV

Comparison of Detergent Compositions Including Branched and Straight Chain Fatty Acids Solid detergent compositions of examples AN-AQ shown in Table 12 demonstrates the disintegration activity of various branched fatty acid disintegrators compared similar formulations containing with linear (non-branched) fatty acids shown in Table 13. As is noticed in the various examples F-M, isononanoic acid, isooctanoic, neodecanoic, neopentanoic acid were utilized along with sodium isononanonate in various amounts. The dissolution rate was measured according to the Dissolution rate test described above. The solid detergent compositions of examples F-M demonstrate improved dissolution of at least 15 g/minute of solid detergent compositions solidified with dense ash. Examples F-L which utilize a branched fatty acid disintegrator whose main chain is octanoic acid or longer (e.g., $C_9$ to $C_{12}$ branched fatty acid disintegrators) demonstrate dissolution of greater than 30 g/minute under the test conditions.

TABLE 12

| | Formula | | | |
|---|---|---|---|---|
| | Example AN Neo-decanoate | Example AO Iso-nonanoic | Example AP Iso-octanoic | Example AQ Neo-pentanoic |
| Water | 5.79 | 5.79 | 5.79 | 5.79 |
| sodium hydroxide 50% | 21.88 | 21.88 | 21.88 | 21.88 |
| phosphoric acid 75% | 12 | 12 | 12 | 12 |

TABLE 12-continued

| | Formula | | | |
|---|---|---|---|---|
| | Example AN Neo-decanoate | Example AO Iso-nonanoic | Example AP Iso-octanoic | Example AQ Neo-pentanoic |
| alkyl imidazolimium dicarboxylate sodium salt 40% | 5 | 5 | 5 | 5 |
| ethoxy-propoxy copolymer | 1 | 1 | 1 | 1 |
| hydroxyethylidene-triacetic acid 40% | 9.95 | 9.95 | 9.95 | 9.95 |
| sodium carbonate | 35.38 | 35.38 | 35.38 | 35.38 |
| neodecanoic acid | 9 | | | |
| isononanoic acid | | 9 | | |
| isooctanoic acid | | | 9 | |
| noepentanoic acid | | | | 9 |
| nonanoic acid | | | | |
| octanoic acid | | | | |
| heptanoic acid | | | | |
| hexanoic acid | | | | |
| Total | 100 | 100 | 100 | 100 |
| Dissolving test | | | | |
| sample wt (g) | 251 | 258 | 250 | 251 |
| dissolve time (min) | 6.4 | 4.9 | 6.4 | 16.6 |
| Temperature ° F. | 155° F. | 155° F. | 155° F. | 155° F. |
| Dissolve rate g/min. | 39 | 53 | 39 | 15 |

Comparative Examples

Detergent Compositions Including Straight Chain Fatty Acids

TABLE 13

| | Formula | | | | |
|---|---|---|---|---|---|
| | Comp. Example AR nonanoic | Comp. Example AS octanoic | Comp. Example AT hepanoic | Comp. Example AU hexanoic | Comp. Example AV alkaseltzer |
| Water | 5.79 | 5.79 | 5.79 | 5.79 | |
| sodium hydroxide 50% | 21.88 | 21.88 | 21.88 | 21.88 | |
| phosphoric acid 75% | 12 | 12 | 12 | 12 | |
| alkyl imidazolimium dicarboxylate sodium salt 40% | 5 | 5 | 5 | 5 | |
| ethoxy-propoxy copolymer | 1 | 1 | 1 | 1 | |
| hydroxyethylidene-triacetic acid 40% | 9.95 | 9.95 | 9.95 | 9.95 | |
| sodium carbonate | 35.38 | 35.38 | 35.38 | 35.38 | |
| neodecanoic acid | | | | | |
| isononanoic acid | | | | | |
| isooctanoic acid | | | | | |
| noepentanoic acid | | | | | |
| nonanoic acid | 9 | | | | |
| octanoic acid | | 9 | | | |
| heptanoic acid | | | 9 | | |
| hexanoic acid | | | | 9 | |
| Total | 100 | 100 | 100 | 100 | |
| Dissolving test | | | | | |
| conditions: 155° F., 4 liter volume | | | | | |
| sample on mesh 7.5 cm from bottom of beaker | | | | | |
| sample wt (g) | 254 | 248 | 255 | 253 | 3.28 |
| dissolve time (min) | 27.8 | 10.2 | 13.8 | 18.4 | 0.2 |
| Dissolve rate g/min. | 9 | 24 | 18 | 14 | 14 |

Removal of Free Oil from Stainless Steel Slide

The next procedure developed for the present invention tested the dissolve solutions for the ability to remove free oil from stainless steel slides. The following procedure was developed and used to generate the data in this patent application.

1. Prepare a 100 mL solution of used fryer oil and fryer cleaner solution in a 250 mL beaker. The solution should be 2% oil by volume. For testing solid detergent composition, the fryer cleaner solution should be about 5 wt % cleaner. See table 14 below for make-up of 100 mL solutions.

TABLE 14

| Product Type tested | Solid detergent composition |
|---|---|
| Volume of oil (mL) | 2 |
| sg of oil (g/mL) | 0.9 |
| wt of oil (g) | 1.8 |
| volume of fryer cleaner solution (mL) | 98 |
| sg of cleaner soln (g/mL) | 1.0 |
| wt % of cleaner in solution | 5.00 |
| g of cleaner | 4.9 |
| g of water | 93.1 |

2. Wash, dry, and weigh stainless steel slides. The slides dimensions should be approximately 1.5 inches long and 1.0 inch wide. Use a scale to weigh the slides that can measure to four digits after the decimal point. For each beaker of cleaner solution, prepare two slides.

3. Using a hot plate, heat the oil/cleaner solution to boiling.

4. When solution is boiling, place two pre-weighed slides in each beaker of solution.

5. Allow the slides to come to the temperature of the solution.

6. Remove the slides with tongs, and allow them to air dry. Dry the slides on an incline so that neither side is flat on the benchtop.

7. Weigh the slides again, and calculate the grams of oil residue per square inch.

8. The most successful cleaning product will have the lowest grams of oil residue per square inch.

Table 15 presents several formulations of solid detergent compositions including Isononanoic Acid, Sodium Salt in amounts sufficient for disintegrator and hydrotrope functions. The solid detergent formulations from Table 15 are used in comparison tests to other detergent compositions for reducing the amount of free oil attached to slides according to the testing procedure above. Results are presented in Table 16.

TABLE 16

Solid Detergent Composition --Fryer Cleaner formulas

| | AW | AX | AY | AZ | BA | BB | BC | BD | BE |
|---|---|---|---|---|---|---|---|---|---|
| Water | 9.00 | 14.93 | 8.3 | 14.7 | 12.3 | 27.6 | 10 | 10 | 6.6 |
| linear alcohol ethoxylate 25-3 | | | | 1.8 | | | | | |
| sodium isononanoate 45% | 20.00 | 19.64 | 16.2 | 20 | 19.2 | 17 | 20 | 20 | 20 |
| Dicarboxylic Coconut deriv. Sodium. Salt, 38% | | | | | | | | | 6.8 |
| linear alcohol ethoxylate 12-6 | 2.00 | 1.79 | 1.5 | 1.8 | 1.7 | | | 1.7 | |
| linear alcohol ethoxylate 91-2.3 | 2.00 | 1.77 | 1.5 | | 1.7 | | | 1.7 | |
| Polyacrylic acid 46% | 2.00 | 1.78 | 1.5 | 1.8 | 1.7 | 1.4 | | | |
| sodium diethylenetriamninepentaacetate | 10.00 | 8.90 | 7.4 | 8.9 | 8.9 | 7.7 | 20 | 20 | 20 |
| urea | | | 8.2 | | | | | | |
| sodium acetate | | | 4 | | 14.5 | | | | |
| sodium carbonate | 45.00 | 42.26 | 51.4 | 50 | 40 | 46.3 | 50 | 46.6 | 46.6 |
| sodium tripolyphosphate | 10.00 | 8.93 | | | | | | | |
| sodium tripolyphosphate hexahydrate | | | | 1 | | | | | |
| Total | 100.00 | 100.00 | 100.00 | 100.00 | 100.00 | 100.00 | 100.00 | 100.00 | 100.00 |

TABLE 17

Oil Residue Test on Stainless Steel Slides

| | Test Solution | | | | | Surface covered (1) | | Surface covered (2) | | Total | | |
|---|---|---|---|---|---|---|---|---|---|---|---|---|
| Cleaner Used | Amt Oil (g) | Amt water (g) | Amt soap (g) | Wt slide clean | Wt slide dirty | Width (in) | Height (in) | Width (in) | Height (in) | surface area (in^2) | g of soil/in^2 | Average |
| AW | 1.82 | 93.1 | 4.9 | 18.5202 | 18.5205 | 1 | 1.3125 | 1 | 1.375 | 2.6875 | 0.0001116 | 0.0001 |
| | | | | 18.5699 | 18.5704 | 1 | 1.5 | 1 | 1.5625 | 3.0625 | 0.0001633 | |
| AX | 1.8 | 93.1 | 4.9 | 18.5265 | 18.5293 | 1 | 1.5 | 1 | 1.6875 | 3.1875 | 0.0008784 | 0.0008 |
| | | | | 18.5918 | 18.5942 | 1 | 1.5 | 1 | 1.5625 | 3.0625 | 0.0007837 | |
| AY | 1.82 | 93.1 | 4.9 | 18.5656 | 18.567 | 1 | 1.4375 | 1 | 1.375 | 2.8125 | 0.0004978 | 0.0007 |
| | | | | 18.5598 | 18.5623 | 1 | 1.375 | 1 | 1.25 | 2.625 | 0.0009524 | |
| AZ | 1.79 | 93.1 | 4.9 | 18.4948 | 18.495 | 1 | 1.5 | 1 | 1.25 | 2.75 | 7.273E−05 | 0.0001 |
| | | | | 18.293 | 18.2936 | 1 | 1.4375 | 1 | 1.3125 | 2.75 | 0.0002182 | |
| BA | 1.79 | 93.1 | 4.9 | 18.4522 | 18.4538 | 1 | 1.25 | 1 | 1.25 | 2.5 | 0.00064 | 0.0005 |
| | | | | 18.5223 | 18.5237 | 1 | 1.5 | 1 | 1.75 | 3.25 | 0.0004308 | |
| AZ | 1.79 | 100.2 | 3.04 | 18.5275 | 18.5298 | 1 | 1.5 | 1 | 1.375 | 2.875 | 0.0008 | 0.0009 |
| | | | | 18.5911 | 18.5939 | 1 | 1.375 | 1 | 1.375 | 2.75 | 0.0010182 | |
| BB | 1.8 | 93.1 | 4.9 | 18.6029 | 18.6044 | 1 | 1.5 | 1 | 1.5 | 3 | 0.0005 | 0.0005 |
| | | | | 18.5932 | 18.5944 | 1 | 1.4375 | 1 | 1.25 | 2.6875 | 0.0004465 | |

TABLE 17-continued

Oil Residue Test on Stainless Steel Slides

| | Test Solution | | | | | Surface covered (1) | | Surface covered (2) | | Total | | |
|---|---|---|---|---|---|---|---|---|---|---|---|---|
| Cleaner Used | Amt Oil (g) | Amt water (g) | Amt soap (g) | Wt slide clean | Wt slide dirty | Width (in) | Height (in) | Width (in) | Height (in) | surface area (in^2) | g of soil/in^2 | Average |
| BC | 1.8 | 93.1 | 4.88 | 18.049 | 18.0499 | 1 | 1.375 | 1 | 1.5 | 2.875 | 0.000313 | 0.0003 |
| | | | | 18.5669 | 18.5677 | 1 | 1.375 | 1 | 1.5 | 2.875 | 0.0002783 | |
| BD | 1.79 | 93.14 | 4.87 | 18.3107 | 18.3119 | 1 | 1.375 | 1 | 1.5 | 2.875 | 0.0004174 | 0.0008 |
| | | | | 18.5201 | 18.5235 | 1 | 1.375 | 1 | 1.5 | 2.875 | 0.0011826 | |
| BE | 1.83 | 93.1 | 4.9 | 18.5976 | 18.6061 | 1 | 1.5 | 1 | 1.5 | 3 | 0.0028333 | 0.0022 |
| | | | | 18.6181 | 18.623 | 1 | 1.6875 | 1 | 1.5 | 3.1875 | 0.0015373 | |
| BC | 1.86 | 93.1 | 4.9 | 18.5459 | 18.5469 | 1 | 1.5 | 1 | 1.625 | 3.125 | 0.00032 | 0.0003 |
| | | | | 18.5022 | 18.5028 | 1 | 1.5 | 1 | 1.625 | 3.125 | 0.000192 | |

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A unit dose solid detergent composition comprising:

an alkali metal carbonate in an amount effective to provide a use solution having a pH of at least about 8;

1 to 20 wt. % of a surfactant;

a solidification agent; and at least 0.2 wt. % of a branched fatty acid disintegrator selected from the group consisting of isopentanoic acid, neopentanoic acid, isohexanoic acid, neohexanoic acid, isoheptanoic acid, neoheptanoic acid, isooctanoic acid, neooctanoic acid, isononanoic acid, neononanoic acid, isodecanoic acid, neodecanoic acid, and salts and mixtures thereof;

wherein the solid detergent composition has a dissolution rate when exposed to 4000 mL of aqueous solution at 155° F. of at least 30 g/minute and is free of bleaching agents.

2. The solid detergent composition of claim 1, wherein the branched fatty acid disintegrator is selected from the group consisting of isononanoic acid, isooctanoic acid, neodecanoic acid, neopentanoic acid, and salts and mixtures thereof.

3. The solid detergent composition of claim 1, wherein the branched fatty acid disintegrator is sodium isononanoate.

4. The solid detergent composition of claim 1, comprising between 0.5 wt. % to 5 wt. % of the branched fatty acid disintegrator.

5. The solid detergent composition of claim 1, comprising between 5 wt. % to 20 wt. % of the branched fatty acid disintegrator.

6. The solid detergent composition of claim 1, wherein the solidification agent comprises between 10 to 80 wt. % of sodium carbonate, sodium hydroxide or sodium metasilicate, or combinations thereof.

7. The solid detergent composition of claim 1, wherein the total composition has between 20 wt. % to 40 wt. % sodium carbonate.

8. The solid detergent composition of claim 1, wherein the total composition has between 20 to 40 wt. % sodium carbonate and 15 to 40 wt. % sodium hydroxide.

9. The solid detergent composition of claim 1, wherein the solid detergent composition is in the form of a tablet having a size between about 1 and about 50 grams.

10. The composition of claim 1, wherein the solid is formed by an extrusion process.

11. The composition of claim 1, wherein the solid is formed by a casting process.

12. The composition of claim 1, wherein the solid is formed by a tabletting process.

* * * * *